United States Patent [19]

Smith

[11] 4,267,649

[45] May 19, 1981

[54] INTERCHANGEABLE SHOE

[76] Inventor: Gardner M. Smith, 415 N. 12th St., St. Louis, Mo. 63101

[21] Appl. No.: 36,482

[22] Filed: May 7, 1979

[51] Int. Cl.[3] ..... A43B 3/24; A43B 3/12

[52] U.S. Cl. ..... 36/101; 36/11.5; 36/100

[58] Field of Search ..... 36/101, 100, 11.5, 25 R

[56] References Cited

U.S. PATENT DOCUMENTS

| | | | |
|---|---|---|---|
| 2,761,224 | 9/1956 | Gardiner | 36/101 X |
| 2,957,253 | 10/1960 | Meltzer | 36/11.5 |
| 3,000,116 | 9/1961 | Ally | 36/11.5 X |
| 3,846,919 | 11/1974 | Milotic | 36/100 |

FOREIGN PATENT DOCUMENTS

| | | | |
|---|---|---|---|
| 2246163 | 4/1975 | France | 36/101 |
| 2345096 | 10/1977 | France | 36/101 |
| 448606 | 5/1949 | Italy | 36/25 R |
| 594034 | 10/1947 | United Kingdom | 36/101 |

*Primary Examiner*—James Kee Chi

*Attorney, Agent, or Firm*—Kalish & Gilster

[57] ABSTRACT

An article of footwear of an interchangeable nature permitting alteration by the wearer of the shoe appearance and configuration. There is provided an outsole of unitary construction having toe, central, and heel portions, there being a heel unit carried upon the heel portion of wedge-defining character. A top sole sits upon the heel, having a forward portion attached to the central portion of the outsole. The latter, heel unit and top sole, are secured by a selectively removable cooperative fabric securement and/or T-arrangement. The insole overlies the toe of the outsole, being detachably secured thereto, and preferably interengages portions of the top sole to provide a hinge-defining construction in the central portion of the shoe. A sock liner overlies the insole and top sole, being selectively and easily removed for access to the other elements of the shoe for interchangeability purposes. Various uppers providing front and rear quarters are detachably secured to the shoe at toe and heel portions thereof. A heel unit is covered with a detachable cover which is reversible for providing different exterior colors.

14 Claims, 31 Drawing Figures

FIG. 7
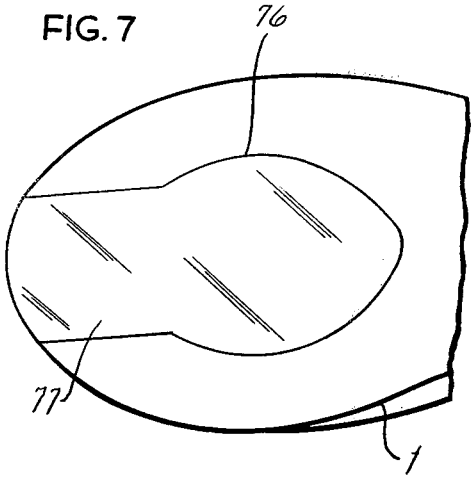
FIG. 8
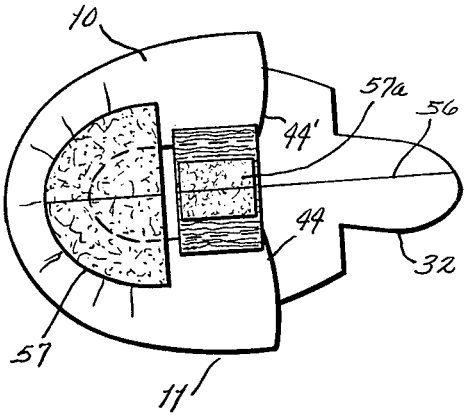
FIG. 9
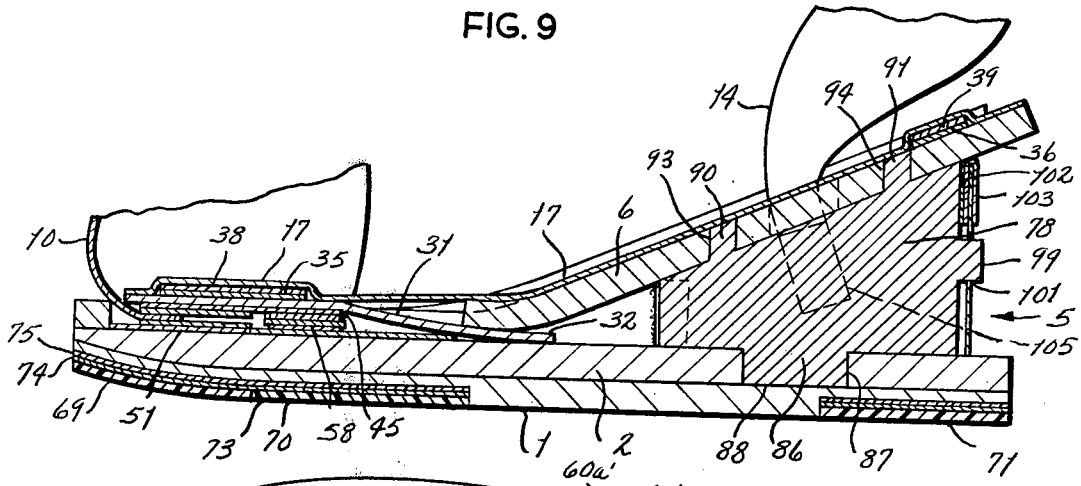
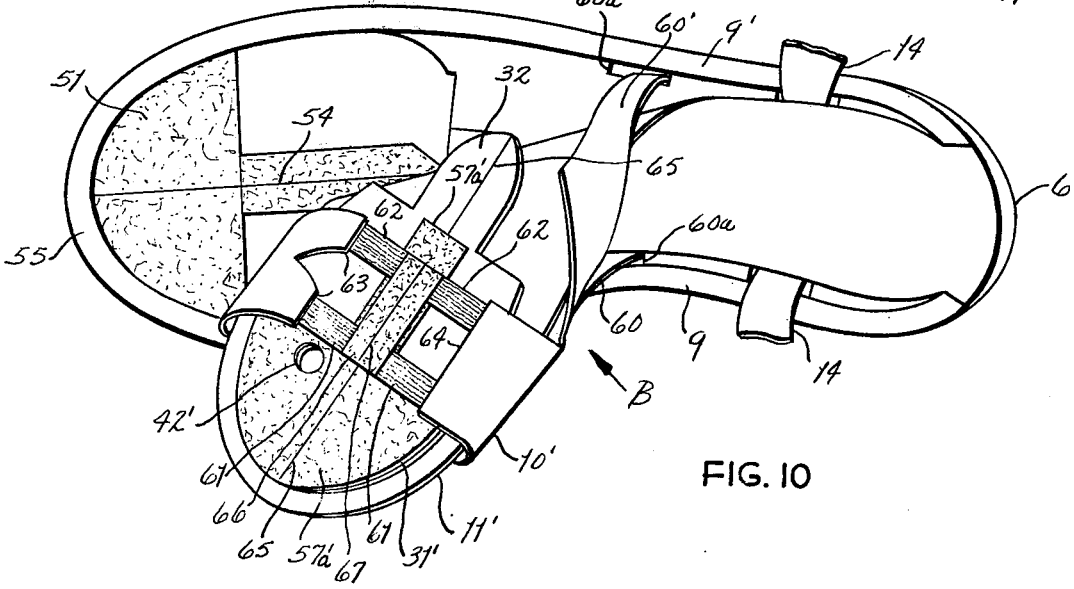
FIG. 10

FIG. 17
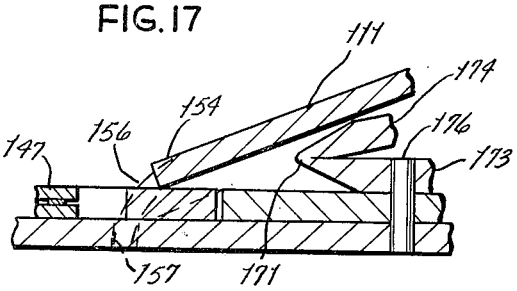
FIG. 18
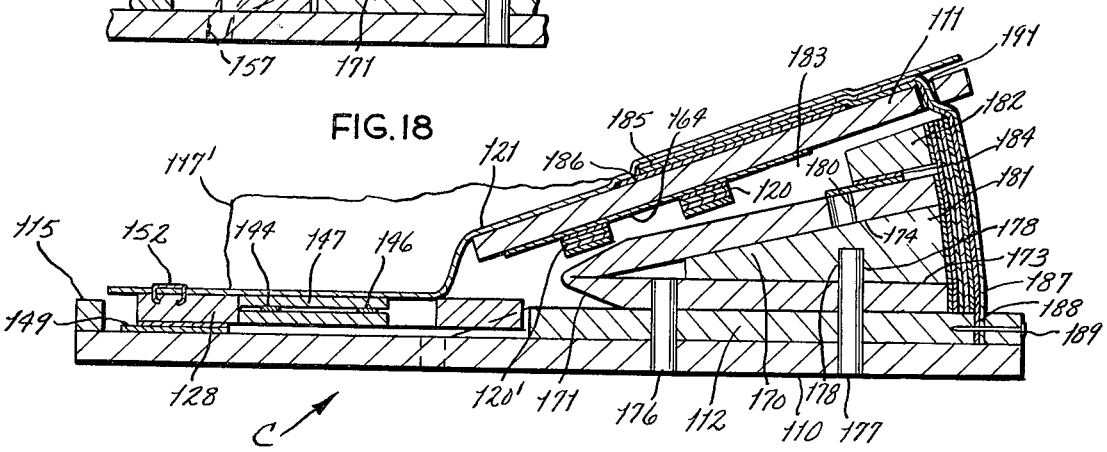
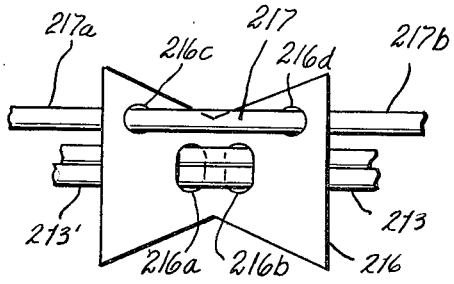
FIG. 20
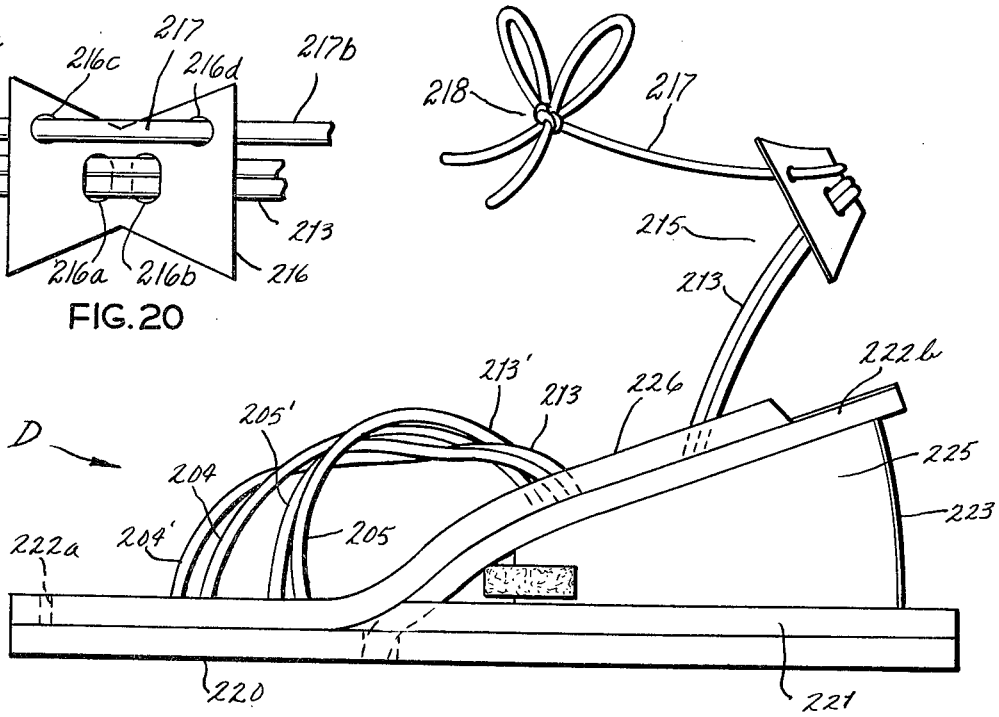
FIG. 19

FIG. 21
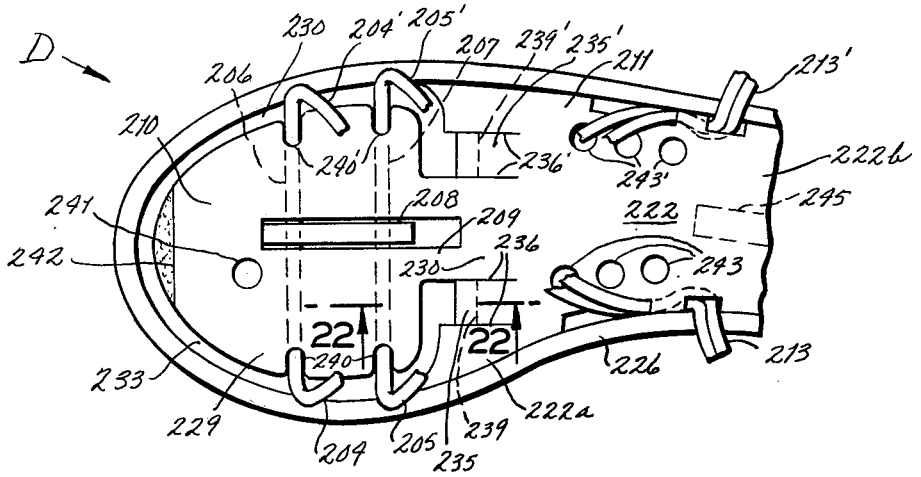
FIG. 22
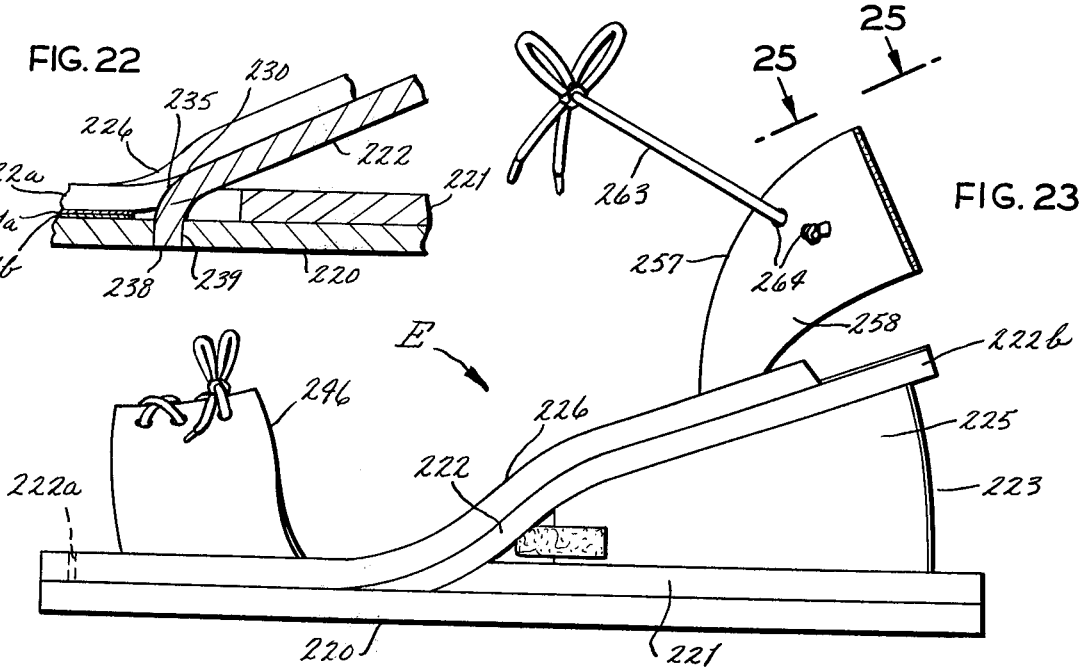
FIG. 23
FIG. 24
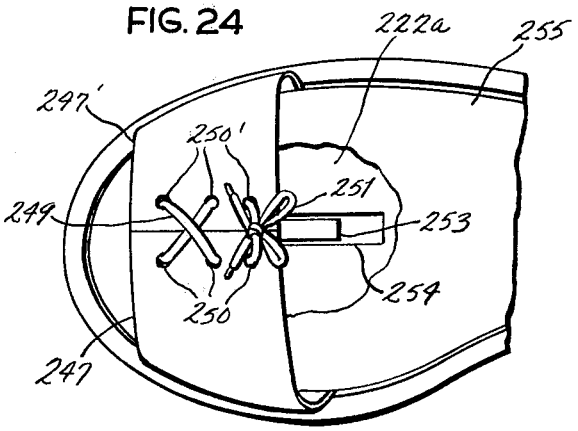
FIG. 25
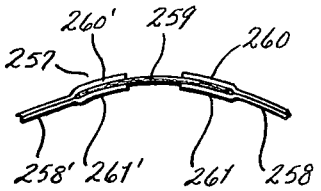

INTERCHANGEABLE SHOE

BACKGROUND AND SUMMARY OF THE INVENTION

This invention relates in general to footwear and, more particularly, to a shoe of a selectively versatile character which is uniquely constructed for interchangeability of styling.

Heretofore, numerous efforts have been undertaken to develop women's shoes for adapting same for facile alteration by the wearer in order to present a variety of appearances and thereby conducing to the versatility of the shoe for different ensemble requirements and the like. Many of such earlier attempts have been directed primarily to what might be considered ornamental effects, such as shown in the patent to Santisi, U.S. Pat. No. 2,759,284 and Bass, U.S. Pat. No. 2,226,110. Other efforts which have been directed more toward alteration in the relationship of the components would be exemplified by the Marx Patent, U.S. Pat. No. 2,367,232, as well as that to Gardiner, U.S. Pat. No. 2,761,224 and Cramer, U.S. Pat. No. 2,509,423.

However, as merely exemplified by the aforementioned patents, such earlier efforts have been of generally restrictive scope, presenting a relatively narrow range of styles. The invention described and claimed in my U.S. Pat. No. 4,114,296 demonstrates the potential for a relatively wide variety of distinct styles upon selective interchangeability of parts by the wearer without resort to extrinsic tools or the exercise of specialized skills.

My above-identified patent discloses a shoe generally of the sandal type which permits the optional incorporation of a heel strap, a front upper or vamp, a thong for securement to a heel strap; and which also permits a width adjustability of the front upper as well as selectivity of heel style to provide either a wedged or substantially flat configuration. An important feature of the invention of the above-identified patent is the provision of structural elements related to permit ready bendability of the shoe within a zone intermediate the heel and sole, i.e., one of increased flexibility.

The present invention constitutes a sign .icant improvement in several aspects over such previously identified efforts of the prior art and, in particular, over that described in my above-identified patent.

Accordingly, an object of the present invention is to provide a shoe designed for women and having components of an interchangeable nature which are uniquely interrelated to provide greatly improved quick and simple alteration of the shoe to effect any of numerous styles permitted by said components.

Another object of the invention is to provide a shoe of the character stated which will accommodate various foot sizes and yet, for all such sizes, is not only comfortable to the wearer but also retains its esthetic character.

A further object of the invention is the provision of a shoe of the character stated which comprises elements which permit ready flexing and bendability of the shoe within a zone intermediate the heel and sole to provide increased walking comfort and natural flexing.

A still further object of the present invention is to provide a shoe of the character stated which has increased arch support for the wearer to enhance walking comfort.

Another object of the invention is to provide a shoe of the character stated which provides a stable and mechanically secure structural nature when the components of the shoe are in their assembled state, and which should become even more stable and mechanically secure upon further wearing of the shoe.

Yet another object of the invention is to provide a shoe of the character stated which embodies cooperative elements which are selectively configured by easy manipulation to provide quick and easy alteration of the outward appearance of the shoe.

It is a further object of the present invention to provide a shoe of the character stated which comprehends a multiplicity of interchangeable constituents which may be easily disposed into chosen selective wearing disposition without resort to extrinsic tools and without requiring advance skill on the part of the wearer so that the average individual can quite simply and rapidly bring about the desired style within the range provided.

It is a still further object of the present invention to provide a shoe of the character stated which is adapted for supporting a readily detachable ornamental element corresponding to particular patterns or color arrangements utilized in other articles concurrently being worn or carried by the user.

It is another object of the present invention to provide a shoe of the character stated which is adapted for carrying of various ornamental elements in desired patterns or color arrangements and which have novel appearance and provide various colorative effects.

It is yet another object of the present invention to provide a shoe of the character stated which may be most economically manufactured; which is extremely durable in usage; and which in and of itself serves the purpose of several pairs of shoes so as to bring about a substantial savings to the user.

BRIEF DESCRIPTION OF THE DRAWINGS

FIG. 7 is a bottom plan view of portions of the shoe, similar to FIG. 6, but illustrating an alternative feature.

FIG. 8 is a bottom plan view of a front half-sole unit utilized in the shoe of FIG. 1.

FIG. 9 is a vertical cross-sectional view, taken along line 9—9 of FIG. 2.

FIG. 10 is a top elevation of the shoe illustrating a front portion of the shoe, including portions of a sock liner and front top mid-sole folded back and showing portions of a rear quarter broken away.

FIG. 17 is a vertical transverse sectional view of portions of the shoe taken substantially along line 17—17 of FIG. 13.

FIG. 18 is a vertical transverse sectional view of the entire shoe taken substantially along line 18—18 of FIG. 12.

FIG. 19 is a side elevational view of yet another embodiment of an interchangeable shoe constructed in accordance with the present invention and illustrating an alternative construction to be utilized in place of the front and rear upper constructions embployed in other embodiments.

FIG. 20 is a front plan view of a rear quarter strap accessory of the shoe of FIG. 19.

FIG. 21 is a top plan view of front portion of the shoe of FIG. 19 with the sock liner thereof having been removed and with portions of strap elements of the shoe being broken away.

FIG. 22 is a vertical sectional view taken substantially along line 22—22 of FIG. 21.

FIG. 23 is a side elevational view of yet another embodiment of an interchangeable shoe construction in accordance with the invention.

FIG. 24 is a top plan view of a front portion of the shoe.

FIG. 25 is a top elevational view of portions of a rear quarter strap of the shoe of FIG. 23 developed along line 25—25 of FIG. 23.

Corresponding reference characters indicate corresponding parts throughout the several view of the drawings.

DESCRIPTION OF THE PREFERRED EMBODIMENTS

Figure 1:
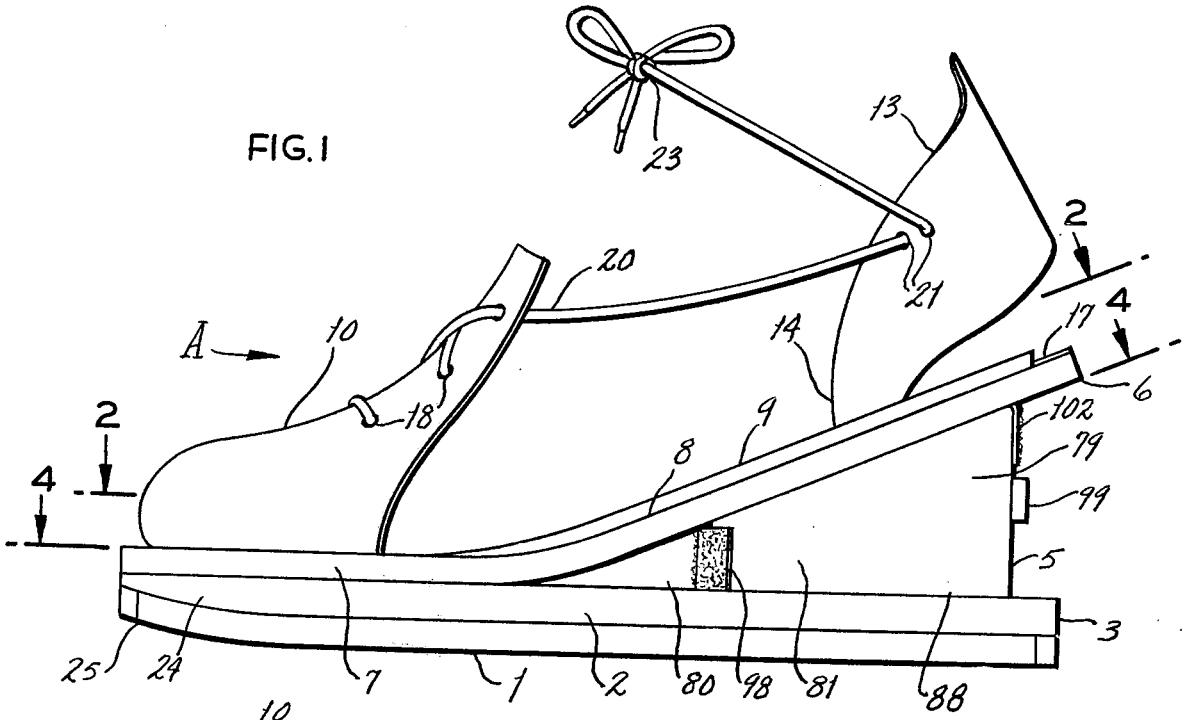
FIG. 1 is a side elevational view of one embodiment of an interchangeable shoe constructed in accordance with and embodying the present invention.

Referring now to the drawings which illustrate practical embodiments of an interchangeable shoe of the present invention, generally designated at A is a woman's shoe of a closed toe configuration, but otherwise generally of a sandal character and of the general type often colloquially referred to as a "wedgie". The shoe has a bottom sole or so-called outsole 1 to which a center sole 2 is secured as later described to provide an essentially integral outer sole assembly or unit 3 to which a heel 5 of essentially wedge-shaped configuration is secured and which extends upwardly from the rear portion of sole unit 3.

A top sole 6 lies above center sole 2 and is secured to the front portion of sole unit 3, thence rising upwardly from center sole 2 in its rearward position, which sits upon heel 5, being preferably secured thereto in a manner described hereinbelow, to provide a downwardly inclined instep portion 8. Top sole 6 is secured at its rearward portion to the upper surface of heel 5 in the manner described hereinbelow and additionally includes along center and rearward portions thereof on each side of the shoe a respective welt 9, 9' preferably of strips of the same material as top sole 6. The welts may extend forwardly of top sole 6 as well, but are made unnecessary in the forward part of the shoe because of material 7 which surrounds an opening in the forward portion of top sole 6 to provide effectively a continuation of welts 9, 9'. Such welts may be either integrally formed, as by moding, with top sole 6, or else adhesively secured thereto.

Figure 3:
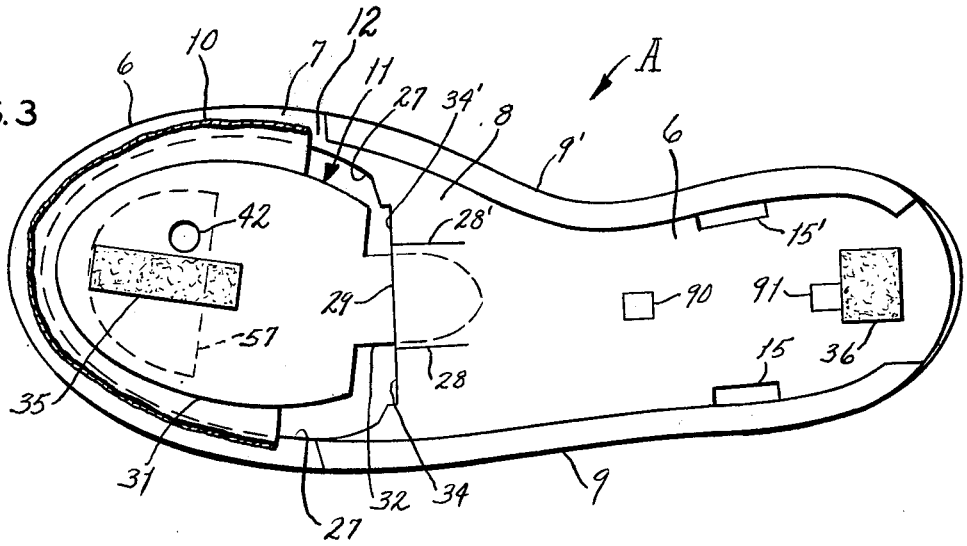
FIG. 3 is a top plan view of the same shoe with a top sole, as well as the front and rear uppers, having been removed.

Positioned upon top sole 6 and secured in a manner to be described hereinbelow is a front quarter or so-called vamp 10 of closed-toe type which is a part of a vamp unit designated in FIG. 3 in its entirety at 11. Similarly, at the rear of the shoe is located a rear quarter in the form of a sling 13 having a pair of straps 14, 14' secured to opposite sides of the shoe and extending through corresponding slots 15, 15' of a sock liner 17 which provides a finished surface for bearing the foot of the wearer.

Exemplarily, vamp 10 is of the type having a plurality of apertures or eyelets 18 through which is threaded a length of lace material 20 extending forwardly from the sling for being tied as indicated at 23 around the ankle of the wearer.

More specifically, outsole 1 is preferably of unitary construction of a suitably molded durable, hard wearing elastomeric material such as rubber, rubber composition material, plastic or resinous material, or various polymers. If desired, however, the outsole may be produced from leather, composite leather, or wood, or combinations thereof. However, the molded unitary construction is preferable. Center sole 2 is preferably of a similar or identical material and may, if desired, be imparted with a different coloring to provide a stripe or variegated coloration effect along the length of the outer sole unit 3, but in this embodiment, is preferably of a diminished thickness at its forward portions 24 to provide outer sole unit 3 with a tapered characteristic to provide the toe portion 25 of the lower surface of outsole 1 with an upward curvature as indicated in FIG. 1.

The securement of center sole 2 to outsole 1 is preferably by means of a layer of elastomeric adhesive interposed therebetween. Similarly, top sole 6 is preferably adhesively secured to center sole 2 in corresponding fashion and is preferably of the same molded synthetic material as that employed for outsole 1 or center sole 2 to provide a unitary construction and, again, may be of a contrasting color if desired.

As noted, top sole 6 is configured to provide a continuous surface only in the rearward part of the shoe, that is from a point proximate the ball of the foot of the wearer and thence rearwardly through instep portion 8 and over the heel 5. But in its forward portion, the top sole is provided with a large central aperture 27 to present a peripheral border 12 in the form of a welt which surrounds and generally conforms to the shape of vamp unit 10, and for the purpose of receiving the latter. The forward extent of the instep portion 8 of top sole 6 adjacent aperture 27 is provided with a pair of spaced apart longitudinally extending, substantially parallel slots 28, 28' which together define a tab 29 at the forward edge of instep portion 8 of the top sole for purposes presently appearing.

Fitted within aperture 27 is vamp unit 10 which includes a front top sole insert or vamp half-sole 31 of a removable nature conforming generally to the forepart of the foot of the wearer but providing a peripheral spacing between its margin or edge and the corresponding periphery of aperture 27. Such half-sole, which may be deemed to be an insole or half-insole, is preferably the same type of material as top sole 6 being of a molded synthetic material and of integral nature. Half-sole insert 31 includes a rearwardly projecting tab 32 which extends under the tab 29 and is maintained in position between slots 28, 28' by the material 34, 34' at the sides of tab 29 which, by virtue of the tendency of the top sole 6 to remain flat, projects slightly below the level of tab 29. Thence, tab 32 is maintained in place between slots 28, 28' and the lateral alignment of half-sole 31 is retained even upon flexure of the shoe and side-loads encountered during wearing. In this way, a hinge-defining construction is obtained for enhanced flexibility in the central part of the new shoes.

Figure 2:
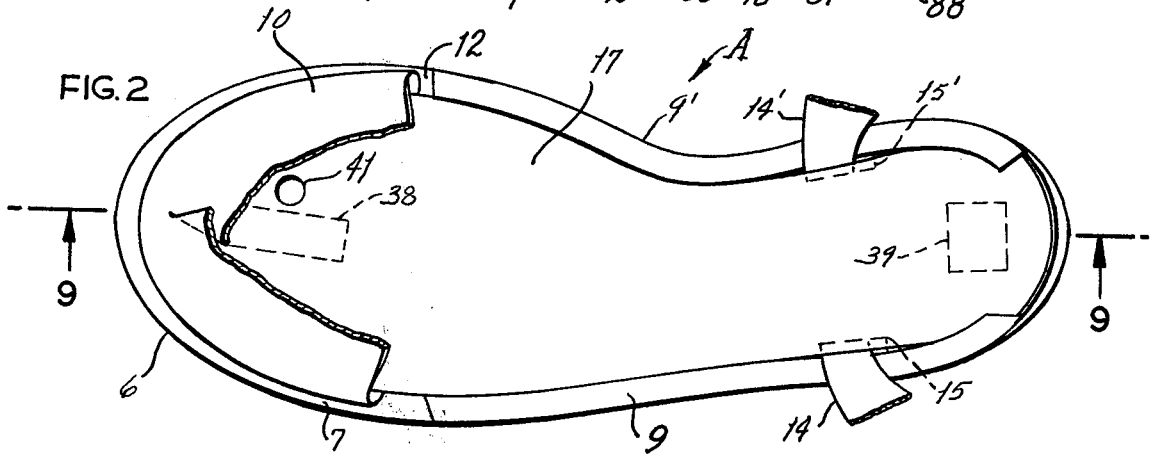
FIG. 2 is a top plan view of the shoe of FIG. 1 with the front and rear uppers being broken away.

Vamp unit 11 is secured to the shoe in position by the interengagement of layers of cooperative hook-and-pile fabric, such as that available under the trademark VELCRO, which layers are interposed between half-sole 31 and sole 2 as described hereinbelow. Sock liner 17 (which has been removed from the assembly of FIG. 3) is secured to half-sole 31 and to top sole 8 by rectangular areas 35, 36 of such cooperative fabric which are adhesively secured to half-sole 31 and to top sole 8, respectively, at the opposite ends of the shoe. Identical areas of such cooperative fabric are adhesively secured as by adhesive stitching or stapling to the lower surface of sock liner 17, these being outlined by dotted lines as indicated at 38, 39 in FIG. 2.

As known by those skilled in the art, such cooperative hook-and-pile fabric conventionally is employed in the form of one layer of either hook or pile configuration and against which layer is placed another layer of the opposite type of material, e.g., pile or hook material, respectively. Conventionally, also, the hook fabric is referred to as the "male" material and the pile fabric designated the "female" material. For the purpose of securement of sock liner 17 to half-sole 31 and top sole 6, however, the layers of material 38, 39 may be of either type so long as the layers 35, 36 are of the opposite type.

While the shoe of FIG. 1 is observed to be of a closed toe configuration, for reasons more readily understood from reference to the following description, the vamp or upper 10 of vamp unit 11 may be removed and the shoe may be utilized in a sandal character by replacement of vamp 10 with a thong or another type vamp of quarter, e.g., of open toed or sandal character. For this purpose, both sock liner 17 and half-sole 31 are provided with respective apertures 41, 42 through which a thong (not shown) of leather or other synthetic material may be extended and secured by cooperative fabric of the type described, all as substantially shown and described in my above-described U.S. Pat. No. 4,114,296.

Figure 4:
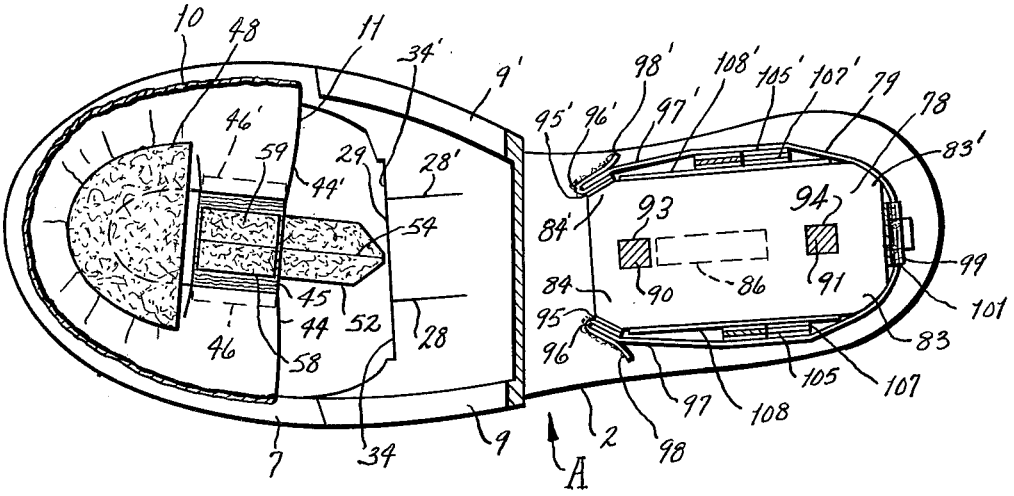
FIG. 4 is a partial horizontal transverse sectional view taken substantially along line 4—4 of FIG. 1 with certain portions of the shoe having been removed.

Referring now to FIG. 4, vamp unit 11 is more specifically revealed as to its features. Vamp 10 is constituted by an under-folded single piece of material having marginal portions 44, 44' which are interengaged by a strip 45 of elastic material which is suitably secured to said marginal portions as by being interposed between layers thereof, such being indicated by dashed line areas designated 46, 46'. An approximately semi-circular shaped layer 48 of cooperative fabric material of the type previously identified is positioned across the marginal portion 44, 44', as illustrated in FIG. 4, so as to lie forwardly of elastic strip 45. Layer 48 is of sufficient area as to provide cooperative interengagement for securement purposes with a correspondingly shaped area 49 (FIG. 3) of cooperative fabric carried on the under surface of center sole 2. Areas 48, 49 are of opposite (male-female or female-male) types, of course.

Figure 5:
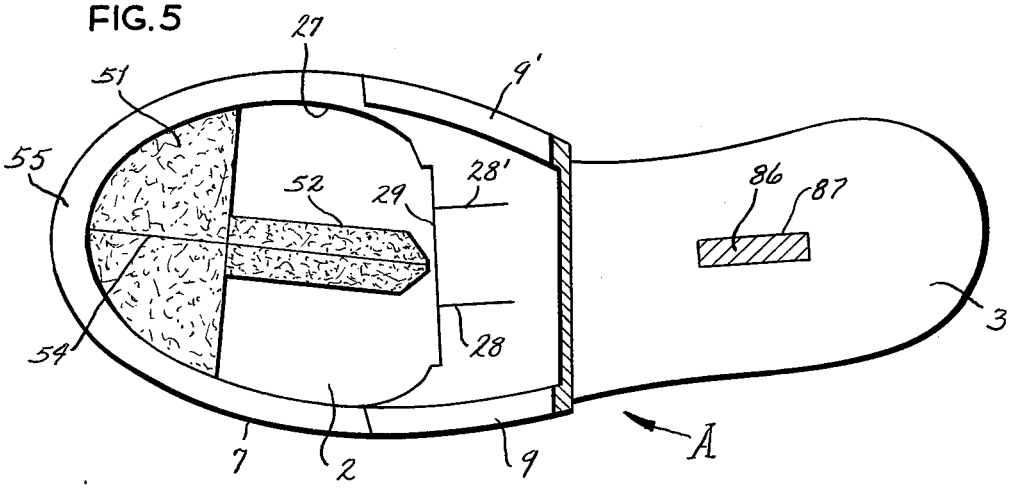
FIG. 5 is a transverse sectional view similar to FIG. 4 but with the front quarter as well as the heel assembly having been removed.

Referring to FIG. 5, center sole 2 is provided with a first generally semi-circular area 51 of cooperative fabric of the previously noted type adhesively secured across the forward part of the aperture 27 in top sole 6, which area is surrounded by a welt or peripheral region 12 of the material constituting the top sole. A further area 52 of such material in the form of a relatively narrow strip extends longitudinally rearward from area 51 generally toward tab 29 and is also adhesively secured to center sole 2. Both of areas 51, 52 are provided with a prominent line 54 marked from the forward portion 55 of welt 12 and extending longitudinally rearward therefrom along the center line of strip-like area 52 for providing an alignment indicium for assembly of parts of the vamp unit with respect to the shoe, as more fully developed hereinbelow.

Referring also to FIG. 8, carried upon the bottom surface of vamp insert 11 is a corresponding semicircular area 57 including a rearwardly-extending rectangular portion 57a adjacent area 57 but carried upon the lower surface of elastic strip 45, both being of the cooperative material but of type opposite from areas 51 and 52 for being interengageable with them to secure vamp unit 11 to center sole 2. The vamp unit may also be provided with a further area of such cooperative fabric which underlies elastic strip 45 (FIG. 4), for interengagement with area 52 of the cooperative fabric, the latter being of opposite type from that which underlies elastic strip 45, so as further to enhance the securement of the vamp unit center sole 2.

For purposes of alignment of the vamp unit in a precise manner so as to achieve a proper fit by the wearer within the shoe as well as to enhance appearance, the vamp unit is provided with an indicium 56 (see FIG. 8) in the form of a line like that corresponding to line 54, and such is preferably applied to a layer 58 of the cooperative fabric which is adhesively secured to the upper surface of elastic strip 45, as designated at 59 in FIG. 4, wherein it is readily perceived that lines 54 and 59, which serve as alignment indicia, are in registry.

Rather than using cooperative fabric to provide interengagement of sock liner 17 and vamp unit 11, an interlocking pair of fabric closure elements, e.g., those used for trouser and other clothing closures, having a hook and a hoop for receiving the hook, may be respectively used on the sock liner and vamp unit whereby the user may utilize pulling of the sock liner to remove the vamp unit and yet mutually disengage one from the other when the shoe is being disassembled for reconfiguration. But assuming use of cooperative fabric, the cooperative relationship of the various layers of material constituting vamp unit 11 and half-sole 31, mid-sole 2, etc., as well as the various layers of cooperative fabric, are all depicted in FIG. 9, which shows these various layers with exaggerated thickness, which tend to give the sock liner 17 appearance of having an irregular surface. Yet, in actuality, the various layers of interengageable fabric do not have the thicknesses necessitated for illustrative purposes in FIG. 9 and, therefore, sock liner 17 does not in actuality have a surface which is irregular to any substantial extent.

FIG. 10 depicts a further shoe embodiment B modified by the provision of a different vamp unit 11; the latter differs from vamp unit 11 of embodiment A in that the vamp or front upper 10' is of a sandal type providing an open-toe configuration.

Modified vamp unit 11' includes a half-sole 31' of the same general configuration as that depicted in FIG. 3 for embodiment A, and including a rearwardly projecting tab 32 for fitting below corresponding tab or margin 29 of mid-sole 6.

Upper or vamp 10' is of a strap-like character and is retained in postion relative to half-sole 31' by a pair of strips 61, 62 which extend between opposite underfolded marginal portions 63, 64 of vamp 10'. But also extending from the rear of the vamp are a pair of straps 60, 60' which are seen to extend beneath the sock liner through corresponding apertures 60a, 60*a'* of the sock liner and the top sole for securement in a manner which will become apparent. But these straps 60, 60' are optional. Half-sole 31' is provided with a semicircular area 57' of cooperative material adapted for cooperative interengagement with area 51. It also may be noted that an aperture 42' is provided through half-sole 31' and layer 57', exactly as in embodiment A, for the purpose of securement of a thong should it be desired to reconfigure the shoe in the form of a thong type sandal.

An area 57*a'* of such cooperative material is also adhesively secured to the lower surface of half-sole 31'. Carried between elastic strips 61, 62, and upon both the upper and lower portions thereof are strips of cooperative fabric as designated at 66, such layers being of opposite type from layer 57*a'* of the cooperative material for interengagement therewith, thereby retaining vamp 10' in a fixed relationship to half-sole 31'. A line serving as an alignment indicium and designated 65 is provided longitudinally along the lower surface of half-sole 31' and cooperative layer 57', for use in aligning the vamp unit with respect to line 54 of the center sole 2, and also for permitting alignment of vamp 10' with respect to half-sole 31'. For this purpose, a line 67 is provided on cooperative layer 66 so that proper alignment of all elements of the vamp unit is simply and accurately attained without requiring tedious manipulative readjustment of various elements of the shoe.

Figure 6:
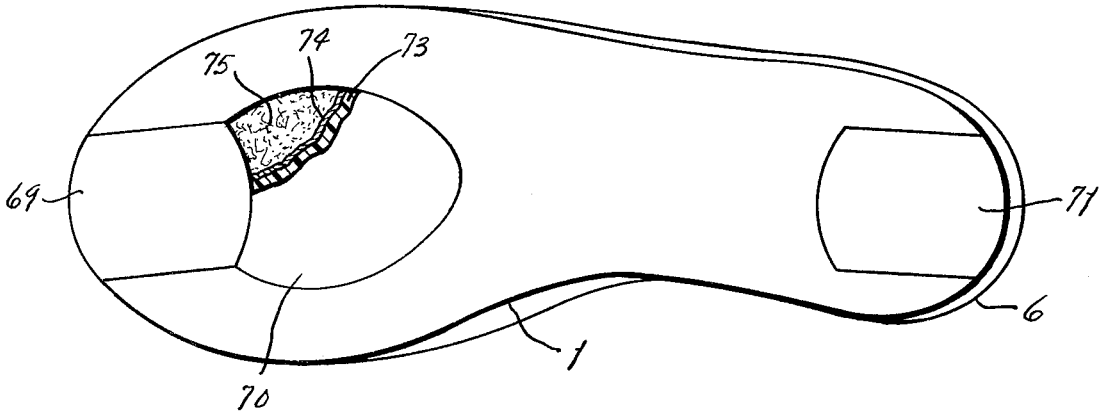
FIG. 6 is a bottom plan view of the shoe of FIG. 1.

Referring now to FIGS. 6 and 7, each of embodiments A and B may be provided with a novel feature presenting surface portions of outsole 1 which are of an interchangeable, multi-use nature. More specifically, outsole 1 is provided with a plurality of sole inserts 69, 70, and 71 which are of a removable, replaceable, and interchangeable nature. Thus, at the front of the outer surface of outsole 1 is provided a toe insert 69 and rearwardly of the same is located a center insert 70 of shape compatible or conformal to the rearward portions of insert 69. At the rear of outsole 1 is provided a heel insert 71 preferably of the same shape as toe insert 69. Each of said inserts comprises a layer 73 of an elastomeric material either similar to outsole 1 or of some other suitable, durable, hard wearing material, such as molded rubber, rubber composition material, plastic or resinous material, as well as various polymers but, in any event, of a flexible nature.

Each of inserts 69, 70, and 71 is of a layer of such material 73 to which is adhesively secured a layer of the cooperative fabric 74 of the type previously described. Such layer 74 is cooperatively interengageable with a further layer 75 of opposite type which is presented by the cavity which receives the respective insert. FIG. 9 is illustrative of the layered relationship of cooperative fabric and material 73 forming each of the inserts.

Because inserts 69 and 71 are of an identical shape, for purposes of inventory and stockage, only one type of insert need be carried by a shoe supplier or manufacturer for use with the shoe. Accordingly, the customer is provided with relatively fewer different parts in order to avoid confusion and provide interchangeability of usage of insert elements. Since heel inserts 71 may be prone to wear more quickly in usage than toe insert 69, prolongation of the life of the shoe is achieved by interchanging these inserts at appropriate intervals.

FIG. 7 illustrates the provision of a single piece insert 76 adapted for replacing the two separate inserts 69 and 70 depicted in FIG. 6. The surface 77 of insert 76 is shown as having a relatively shiny or hard surface character which is in marked contrast with the surface of other portions of outsole 71. Thus, a linoleum-like material may be employed for insert 77 whereas outsole 1 may be of a matte or roughened surface providing a high coefficient of friction with respect to surfaces tread upon by the wearer. Because of the relatively low friction surface 77 of insert 76, the insert is ideal for use in dancing of the type wherein it is desirable to have a capability of making sliding or pivotal movements of the toe of the shoe in various steps.

Such shiny or hard, less frictional, surfaces are merely indicative of various types of surfaces which may be presented by an insert as described. For example, a highly roughened or highly abrasive surface may be utilized for imparting to the shoe a non-slip characteristic as for wearing on slick or dangerous surfaces. Thus, the various types of usages of a convertible shoe of the present character are exemplified by the replaceable nature of the shoe insert. Of course, the heel insert 71 may be of a similar characteristic as insert 76, i.e., one providing a roughened surface for enhanced traction, as on ice. In addition to imparting a multi-use nature to the shoe, the various inserts conduce to extremely long life of the shoe since, by their presence in areas of high wear and heavy concentration of weight during normal usage of the shoe, may be simply replaced when they begin to wear down in thickness even though other portions of outsole 1 are not appreciably worn down.

The features of heel 5 are more specifically seen to include a wedge-shaped heel element 78 which is provided with a removable cover 79 preferably of double-faced, reversible material. Element 78 is preferably a single piece of molded, durable and hard wearing elastomeric material such as rubber or rubber composition material, although it will be apparent that various other materials of a semi-elastomeric or even slightly rigid material, including various plastic or resinous substances, polymeric materials, and the like, including leather, composite leather, or wood may be employed. However, a somewhat elastomeric and at least partly flexible material is employed in order to impart to the shoe a yielding, comfortable nature while serving to maintain top sole 6 in the preferred dispositional relationship with respect to outsole 1 and center sole 2. In addition, instep portion 8, being unsupported in a region 80 just forward of the forward part 81 of the heel is preferably permitted to flex, through compression of heel portion 81, toward center sole 2. This is enhanced by employing an elastomeric material for heel element 78.

While the shape of heel 5 is thus seen in FIG. 1 to be of generally wedge-shaped configuration, except to the extent that such wedge is truncated at forward portion 81 thereof, FIG. 4 reveals the shape of heel 5 in plan to be generally rectangular by having a rounded or beveled rear and front corners 83, 83' and 84, 84', respectively.

Although a single piece of material 78 constitutes heel 5, the same may be constructed of layers of material, one or more of which may be removed to provide varying heel heights in accordance with the teachings of my U.S. Pat. No. 4,114,298, entitled "Interchangeable Sandal". Also, it is envisioned that heel 5 may be made of laminated material, in which case it would be constituted by numerous layers either stacked one above the other or, more preferably, stacked side-by-side, which will facilitate manufacture of the same by simple stamping (die cutting) identically shaped layers.

Referring again to FIG. 4, the heel unit 5 is secured to center sole 2 by a key 86 extending downward from the lower surface of the heel unit into a corresponding aperture 87 of the center sole. As shown by dashed line in FIG. 4, said key 86 is of rectangular shape, being merely an extension of the material 78 which constitutes the body of the heel. Key 86 is preferably adhesively secured within said aperture 87 and also to outsole 1 at the surface 88 thereof contiguous with the outsole. Alternatively, the key may be pinned in place.

Similarly, extending upward from the upper surface of the block of material 78 are a pair of keys 90, 91 fitting within corresponding apertures 92, 93 of midsole 6. These are simiarly of rectangular shape, as shown in FIG. 4, and may be adhesively secured within their respective apertures 93, 94. However, in lieu of having double keys 90, 91 of the upper surface of the block of material 78 constituting heel 5, it is equally preferable to have a single key of elongated rectangular configuration like key 86.

The keyed securement of FIG. 5 to the center sole 2 and outsole 1, as well as to mid-sole 6, provides an extremely secure and mechanically desirable interlocking relationship of the relative parts of the shoe imparting to the shoe durability and resistance to separation of the various elements, even in the presence of substantial side loads upon the heel structure which may be imparted during wearing. But, at the same time, the construction is amenable to mass production manufacture, as by conventional molding techniques and facilitates assembly of the various elements.

As previously noted, heel material 78 is surrounded by a heel cover 79. The securement of the latter to heel material 78 is preferably effected by the use of cooperative fabric material of previously noted type. For this purpose, small areas or layers 95, 95' of such material are adhesively secured to the surfaces of the beveled front corners 84, 84', respectively, of the heel material. Corresponding layers 96, 96' of opposite type cooperative fabric are suitably secured to respective marginal portions 97, 97' of heel cover 79. Layers 96, 96' are preferably wrapped around such marginal portion, to which they may be adhesively secured or stitched, to provide tabs 98, 98' extending outward from the heel cover 79. These tabs are conveniently graspable by the owner of the shoe to remove the heel cover for replacement purposes or when the material is of the preferred reversible nature.

In order to additionally facilitate the application of heel cover 79 to the shoe and for proper orientation of the cover for interengagement of respective layers 95, 96 and 95', 96' of cooperative fabric, the heel material 78 may advantageously include a rearwardly extending key or projection 99 which, like keys 90, 91 and 86 is of rectangular shape. A corresponding aperture 101 of heel cover 79, having the same shape as such extension surrounds extension 99, whereby placement of the heel cover relative to the heel is always assured.

For enhancing securement of the heel cover 79 to the rear heel, a layer 102 of cooperative fabric is secured to the rear face of the heel. Overlying such layer is a further layer 103 of opposite type cooperative fabric which is suitably adhered or otherwise secured as by stitching to the heel cover 79 and which, if desired, may be wrapped around marginal portions of the heel cover, as seen in FIG. 9.

Sling 13 is merely representative of one various rear quarters which may be employed in configuring an interchangeable shoe of the present invention. Regardless of the various types of quarters, for use in conjunction with the present embodiments, such will include a pair of straps which secure the quarter to the shoe and which would be of the general form as those designated at 14, 14' in FIGS. 1, 2, 9 and 10.

Accordingly, the securement of such straps 14, 14' is representative of the securement of straps of various other quarters which may be quite different from sling 13. Referring then to FIGS. 4 and 9, each of straps 14, 14' includes a respective lower extension 105, 105' which is remote from the quarter and is secured to heel 5. Each such extension extends downwardly from the strap portions 14, 14' which pass through apertures 15, 15' in shoe midsole 6. These apertures are such as to lie along the sides of the block of heel material 78 so that the strap extensions 105, 105' similarly lie adjacent the sides of the heel. Each such extension carries on its inward faces a corresponding area 107, 107' of cooperative fabric, as by being stapled or adhesively secured thereto, with the engageable surface of such cooperative fabric being oriented toward the outward surface of the block of heel material 78. Respective layers 108, 108' of cooperative fabric of the opposite type are adhesively secured to the side surfaces of the block of heel material 78, as may be seen in FIG. 4 so that layers 107, 107' carried by strap extensions 105, 105' are interengageable therewith. Heel cover 79 then extends over such strap portions 105, 105' to conceal them from outside view, as will be appreciated from FIG. 1. Such arrangement provides for selectively adjustable positioning of the quarter with respect to the heel, owing to the extent of forward and rearward adjustment permitted by slots or apertures 15, 15' which are somewhat longer than the width of the straps 14, 14' of the sling. Therefore, the wearer may adjustably secure sling 13 to provide a desired fit, as well as orienting the angle of the strap about the ankle as may be desired for comfort and appearance.

Heel cover 79, as well as sling 13 and vamp 10, or the alternative vamp configuration 10' of FIG. 10, all may be constructed of a double-faced synthetic elastomeric marterial, such as a vinyl material having different colors or textures on the opposite faces. The cover is then of a reversible nature so that the wearer may configure the shoe to provide various pleasing and unusual color combinations, or may select the color or textured surface outwardly visible to harmonize or contrast with other articles of wearing apparel. In this regard, an advantage of the modular, interchangeable nature of the shoe provides in the capability of the vamp units 10 or 10' to be reversibly oriented. When this is done, the vamp is literally turned inside out. However, owing to the desirable assymetric shape of the shoe, the vamp must then be placed on the opposite shoe. That is to say that the vamps are interchanged with the left and right shoes when the color surface outwardly displayed is reversed, as by turning the vamp inside out.

Figure 11:
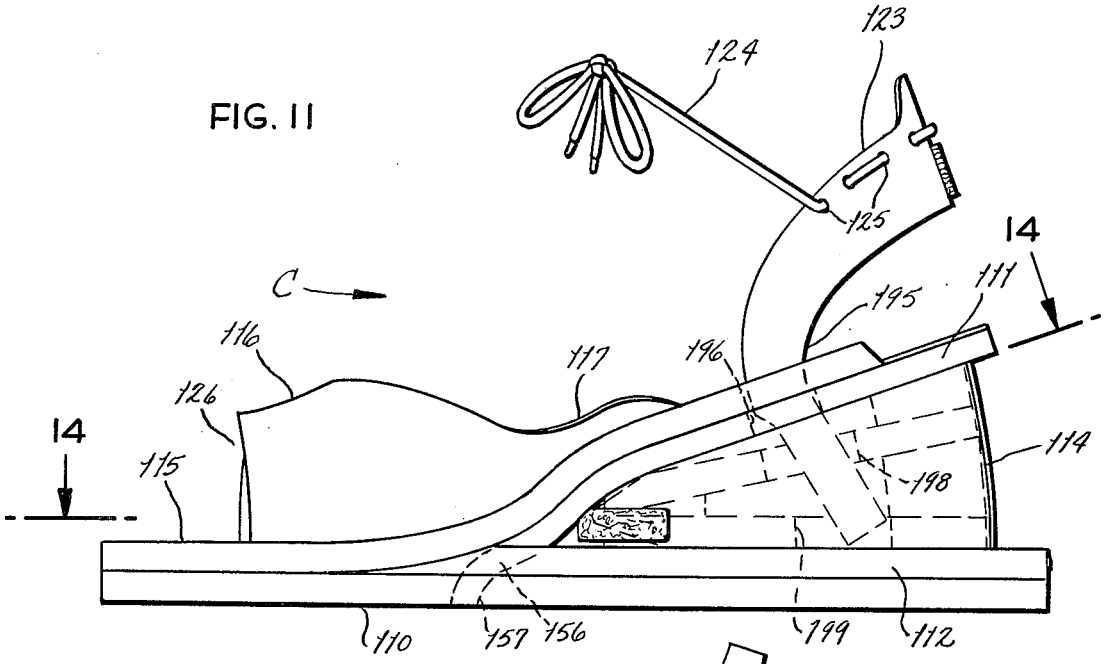
FIG. 11 is a side elevational view of the second embodiment of an interchangeable shoe constructed in accordance with and embodying the present invention.
Figure 12:
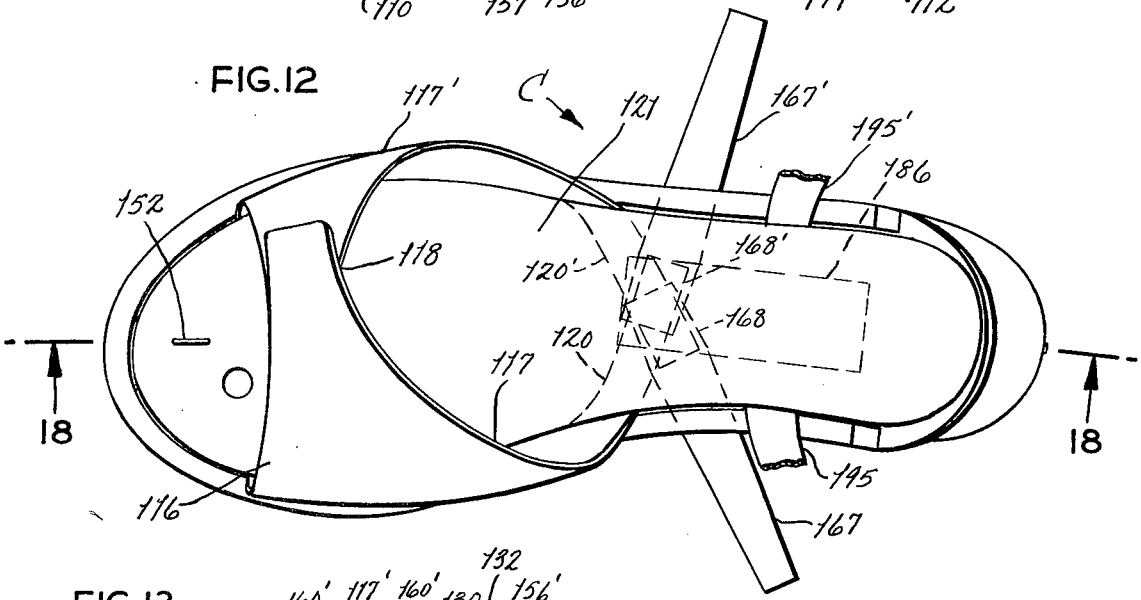
FIG. 12 is a top plan view of the shoe of FIG. 11, illustrating also certain strap accessories for securement of a vamp to the shoe, the rear quarter being depicted broken away.
Figure 13:
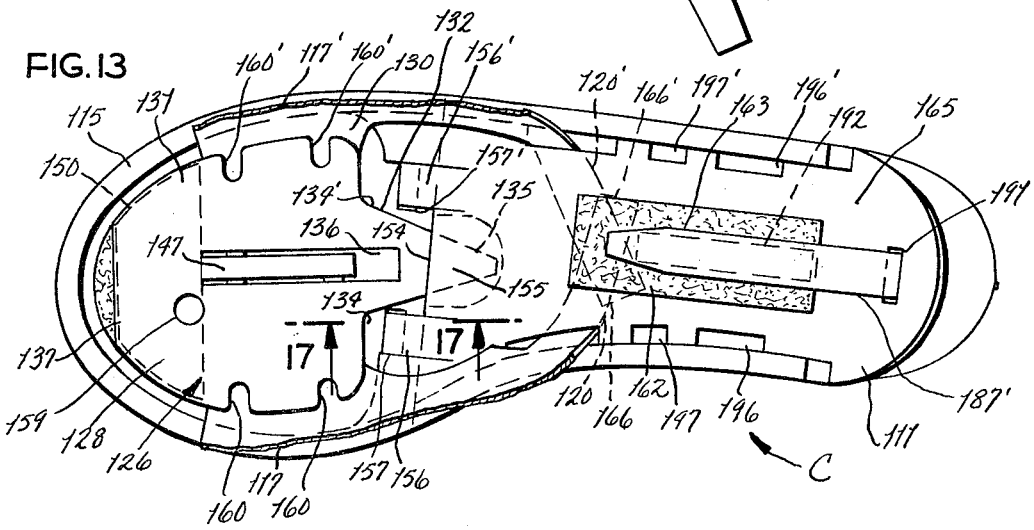
FIG. 13 is a horizontal sectional view of the shoe of FIG. 11 with a sock liner thereof and rear quarter having been removed and with the vamp being broken away.

Referring now to FIGS. 11–13, a further shoe embodiment C is illustrated. Such embodiment represents various modifications to an interchangeable shoe within the range of the invention. Like embodiments A and B, embodiment C is of a "wedgie" type but is of an open toe configuration.

The shoe of embodiment C has a bottom sole or outsole 110 to which an inclined top sole 111, corresponding to top sole 6 of embodiment A, is attached at an intermediate portion of outsole 110, there being an upper outsole 112 in the rear portion of the shoe lying above the rear upper surface of outsole 110 but not extending the full length of the shoe as in the case of center sole 2 of embodiment A. The materials of which outsole 110 and top sole 111 are made, as well as other elements of embodiment C, are preferably the same as utilized to construct the corresponding components and elements of embodiments A and B.

A wedge-shaped heel 114 is secured between top sole 111 and upper half-outsole 112. Extending peripherally around the upper surface of outsole 110 and thence rearwardly on both sides of the shoe, but terminating proximate the rear portion of heel 114 is a continuous welt 115 of material like that of outsole 110 and top sole 111 and preferably being adhesively secured thereto.

Positioned upon outsole 110 and secured not only to the latter but also to portions of top sole 111 is a front quarter or vamp 116 of open-toe configuration having portions 117, 117' which are overlapped at 118 for purposes of securement to one another. Each of said portions 117, 117' extends rearwardly as a pair of respective straps 120, 120' which are described hereinbelow but which extend beneath a sock liner 121 of the shoe.

At the rear of the shoe and secured in a fashion corresponding to embodiment A is a sling-type rear quarter 123 to which a string or lace-type tie 124 is secured by being threaded through eyelets 125 along the sides and rearwardly of the sling, for tying the rear quarter about the ankle of the wearer.

Referring to FIGS. 11–13, vamp 116 is part of a vamp unit 126 which is more specifically seen to include a top sole insert or vamp half-sole 128 which corresponds to half-sole 31 of embodiment A. The same is fitted within a cavity 130 of the shoe defined by welt 115 and is seen to include an area 131 generally in the shape of the forepart of the foot and having at the rear thereof a triangular shaped tab or projection 132 having relatively widely spaced apart edges 134, 134', which converge toward a relatively sharply pointed tip 135, for purposes more fully set forth hereinbelow.

Figure 15:
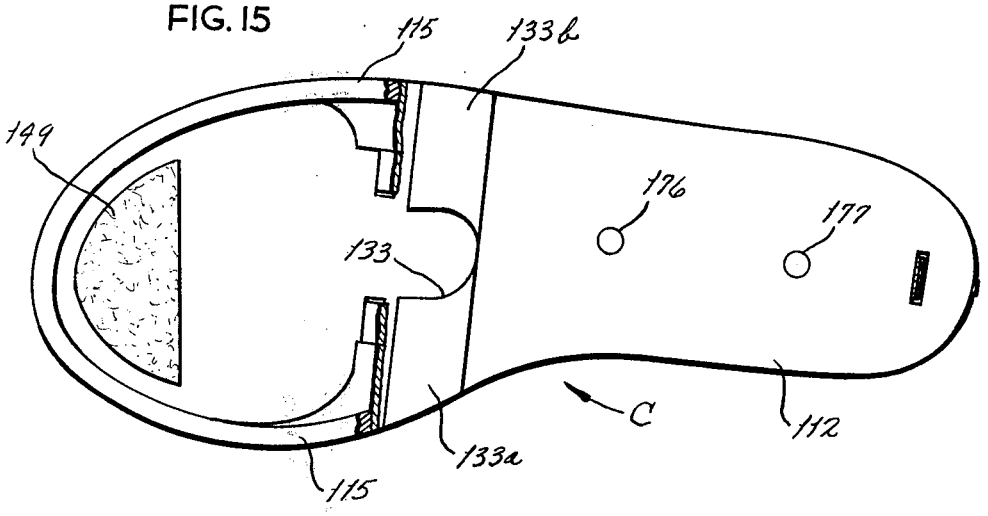
FIG. 15 is a transverse sectional view similar to FIG. 4 but with the front quarter and heel assembly of the shoe having been removed.

Referring to FIG. 15, upper outsole 112 is shown to have a bifurcated forward portion having a pair of shoulders **133*a*, 133*b* which taper suitably from the thickness of the outsole per se to very thin forward edges. These shoulders define a U-shaped recess 133 between them centrally of the shoe and opening toward the toe for receiving tab 132**.

Extending longitudinally of the shoe and located in the approximate center of the width of half-sole 128 is a slot 136 of rectangular shape (see FIG. 13), such slot extending from a point proximate the forward edge 137, which is squared off to a point well into the tab or projection 132. Such slot is utilized for securement of vamp portions 117, 117'.

Figure 14:
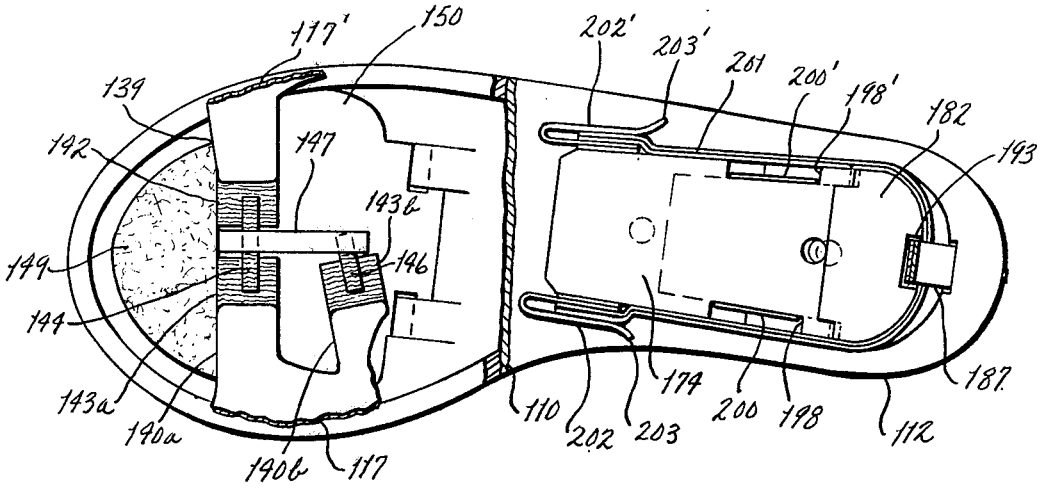
FIG. 14 is a horizontal transverse sectional view taken generally along line 14—14 of FIG. 11 with the front upper being shown in place but broken away in part.

Referring to FIG. 14, wherein the half-sole 128 has been removed, vamp portions 117, 117' each are folded under the half-sole to provide three tabs **139, 140*a* and 140*b*, each having a corresponding length of elastic strip material, respectively designated 142, 143*a* and 143*b*, carried at the end thereof and extending toward the opposite side of the shoe. Elastic strips 142 and 143*a* are interconnected by strip 144 of fabric or other flexible material which may be stitched or adhesively cemented at the opposite ends to these two strips of elastic. A corresponding strip 146 of such flexible material extends distally outward from elastic strip 143*b*. Interconnected with each of flexible strips 144, 146 is a length 147 of somewhat more rigid material, e.g., the general type of elastomeric material constituting outsole 110, fitting within an aperture 136 (as illustrated in FIG. 13**) but providing a relatively loose fit therein.

Thus, length 147 constitutes a key which, upon being fitted within aperture 146, provides for securing the vamp in a stable, fixed lateral position and automatically centering the fabric portions 117, 117' for proper orientation of the vamp laterally with respect to the shoe. In addition, it is preferred that aperture or slot 136 be of somewhat longer dimensions than key strip 147, as shown in FIG. 13, so as to permit forward or rearward movement of the strip within such aperture so that longitudinal placement of the vamp may be as desired. Key 147 is formed in two pieces (see FIG. 18) with strip 144 passing between them.

Referring again to FIG. 14, a semi-circular area 149 of cooperative fabric is adhesively secured, stapled or stitched to the upper surface 150 of outsole 110 at the toe of the shoe, for purposes of securement of half-sole 128 within the sole. The latter includes a corresponding area 150 securely fastened to its lower surface at the toe of the shoe, and being of the opposite type for interengagement for fabric 149, thereby providing for adhesion of half-sole 128 to the toe of the shoe. Sock liner 121 is preferably securely fastened to half-sole 128, as by a staple 152 shown in FIG. 12, so that upon pulling up of the sock liner, the user can be assured that half-sole 128 and vamp unit 126 of which it is a part will be removed from the shoe for adjustment, for replacement of the vamp with a different style.

Figure 16:
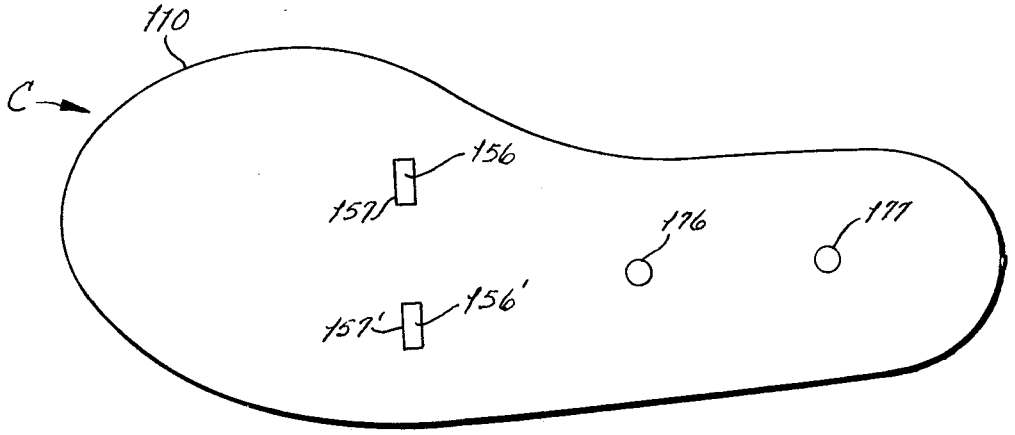
FIG. 16 is a bottom plan view of the shoe of FIG. 11.
Figure 26:
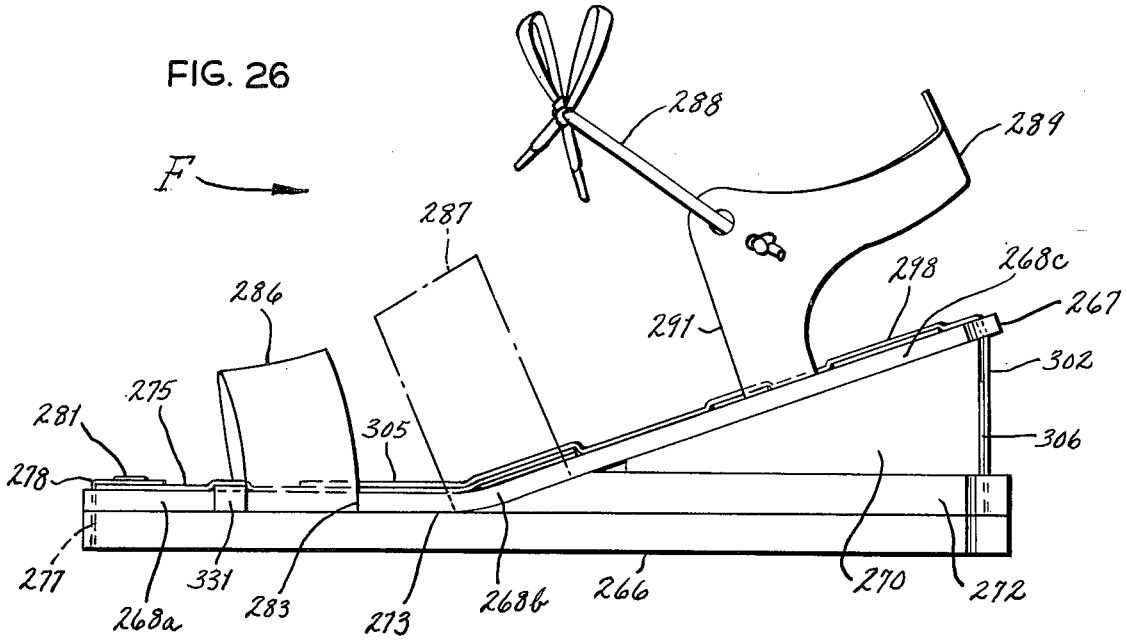
FIG. 26 is a side elevational view of a further embodiment of an interchangeable shoe constructed in accordance with and embodying the present invention.
Figure 27:
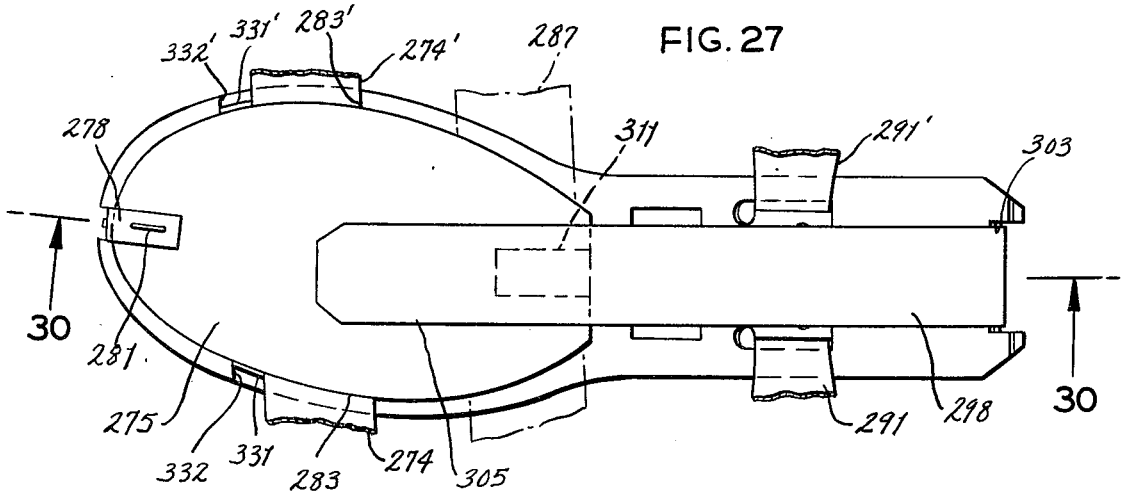
FIG. 27 is a top plan view of the shoe of FIG. 26, vamp and rear quarter elements of the shoe being depicted broken away.

Extension or tab 132 of the half-sole insert is adapted to fit within a slot 154 defined by a tab 155 at the forward part of top sole 111 and which is bounded on opposite sides by spaced apart forwardly extending tab-like extensions 156, 156' which latter, by reference to FIGS. 11 and 13, and especially to FIG. 17, are more clearly seen to bend forwardly and downwardly into corresponding rectangular apertures 157, 157' within outsole 110. As viewed in FIG. 16, these extensions or tabs 156, 156' are closely fitted into the apertures 157, 157' and are adhesively secured or pinned therein to provide a dimensionally stable, strong and hinge-like flexible interconnection of the forward portion of top sole 111 with outsole 110. The purpose of the triangular shaped or tapered configuration of tab 132 is now manifest, since it is seen in FIG. 13 that the latter fits under tab 155 and within slot 154 and may be pushed rearwardly until the shoulders or sides of the tab bear against the tab-like extensions 156, 156' of the top sole, thereby ensuring lateral alignment of half-sole 128 and vamp unit 126 of which it is a part.

Further features of the vamp unit may be noted as including a circular aperture 159 which permits the use of a thong secured preferably by the interengagement of the layers of the cooperative material in accordance with the teachings of my above-identified U.S. Pat. No. 4,114,298. Additionally, the sides of half-sole insert 128 are provided with slots opening outwardly in a U-shaped configuration as shown at 160, 160' in FIG. 13. These slots permit a lace-type vamp (shown in FIG. 19) rather than that constituted by layers of material as illustrated, to be secured to half-sole 128 by laces extending through the slots and then extending under the half-sole.

Referring to FIGS. 13 and 18 (in which thicknesses are exaggerated for illustration), straps 120, 120' are retained in place at their proximal ends in the region designated 162 by a layer 164 of the above-described cooperative fabric which is secured to the lower surface of top sole 111. Cooperative fabric layer 164 may be stapled or adhesively cemented in place. Each of straps portions 120, 120' has areas 166, 166' of the cooperative fabric carried at the proximate ends thereof, as indicated by dashed lines in FIG. 13. Preferably, the securement of straps 120, 120' by engagement of cooperative fabric is in the staggered manner suggested by FIG. 18 rather than overlapped, as FIG. 12 would seem to imply. Areas 166, 166' thus are interengageable with cooperative fabric 164 for securement of straps 120, 120' in the position shown but serving additionally to permit selective adjustment of the shoe in a novel manner. Such adjustment is made possible by the use of extension straps 167, 167', each of which has a respective area 168, 168' of cooperative fabric of the type opposite to that of areas 166, 166' whereby extension straps 167, 167' are readily interengaged with strap portions 120, 120' and they then extend from opposite sides of the shoe as illustrated in FIG. 12. Extension straps 167, 167' may be grasped by the wearer after having inserted the foot within vamp 116 and then pulled in opposite directions to cause tightening of the vamp around the foot. At a predetermined tension at which the cooperative fabric elements separate, strap extensions 167, 167' separate from straps 120, 120' leaving the vamp in a snug secure relationship to the foot and leaving the straps 120, 120' secured in the region 162 to cooperative fabric layer 163.

Secured to the top surface 165 of top sole 111 is another rectangular area 163 of cooperative fabric for purposes of securing in place elements of heel 114. Referring to FIG. 18, it will be seen that heel 118 of embodiment C includes a layer 170 of synthetic resin material or other elastomer of one of the previously other mentioned types which is folded back upon itself as indicated at 121 in a reduced thickness area so as to provide in two layers 173, 174 which diverge from the fold 171 in angular relationship to provide the requisite wedge-like configuration of the heel.

Lower layer 173 is secured to outsole 110 and upper outsole 112 by the provision of a pair of plugs or keys 176, 177 which extend through apertures in each of these three layers and preferably being formed of a resilient, elastomeric material of the same type as that employed for outsole 110 and upper outsole 112. These keys may be adhesively cemented in the respective apertures and are seen, in FIGS. 15 and 16, to be of circular cross-section. Key 176 is of the same length as the composite thicknesses of layer 173 and outsole layers 110 and 112. However, key 177 is of somewhat greater length than these composite thicknesses so as to protrude slightly above the upper surface of layers 173 as indicated at 178 for the purposes of extending upward into a wedge-shaped block 181 of elastomeric material, to secure the same in position. Block 181 is selectively removable by the user of the shoe for varying heel height. When block 181 is removed, an aperture 180 in layer 174 receives key extension 178.

Secured to the upper surface of layer 174 by areas 184 of interengaged cooperative fabric is a small, thin block 182 of the same resilient, elastomeric material as that constituting outsole layers 110, 112. Block 182 is of approximately semi-circular shape, as viewed from the above in FIG. 14, the rounded outer surface thereof being slightly notched at the rear for purposes presently appearing. Block 182 provides additional spacing between the upper surface layer 174 and the lower surface of top sole 111 for enhancing the wedged configuration of the heel and providing additional cushioning space 183 between the top sole 111 and upper surface of layer 174 for enhanced comfort in the heel region of the shoe.

Some air space is available between top sole 111 and region 171 defined by the folding of layers 173, 174. Such fold 171 is approximately located at the instep region of the shoe whereby enhanced arch support is attained, conducive to comfort for the wearer. Securement of sock liner 121 to top sole 111 is provided by a layer 185 of cooperative fabric carried upon the lower surface of sock liner 121 (as by being adhesively cemented thereto) and depicted in FIG. 18, whereby an area of interengagement 186 of rectangular configuration is provided between the corresponding rectangular layers 185 and 163 of cooperative fabric, it being understood from reference to FIG. 13 that layer 163 is that layer of cooperative fabric of the opposite type carried upon the upper surface of top sole 111.

For purposes of securement of top sole 111 in the desired configuration shown in FIG. 18, a strap 187 of the above-described cooperative fabric is fastened at a lower end in a slot 188, being there held in place by a pin 189 or by stapling in upper outsole 112. Strap 187 thus extends upwardly from such slot and through a further slot 191 whereupon it is folded forwardly as a portion 187' (See FIG. 13) overlying the upper surface of top sole 111. Strap 187' interengages cooperative fabric 163, the latter being of opposite type, in a region as generally designated by dashed lines at 192 in FIG. 13. Thus, strap 187, when passed through aperture 191 and secured as illustrated, provides a tensile force tending to press top sole 111 downwardly against block 182 and against layer 174. Each of the layers constituting heel 114, i.e., structural layers 173, 174 and block 182 are notched as indicated at 193 to accommodate the width of strap 187.

For securement of quarter 123 to the sides of the shoe, FIG. 12 reveals that quarter 123 has a pair of straps 195,195' at opposite sides thereof which correspond to rear quarter straps 14, 14' of embodiment A. Such straps 195, 195' are similarly secured to the sides of the heel 114 by cooperative fabric securement. For this purpose, each of the layers 173, 174 and top sole 111 is provided with notches on the opposite sides thereof, a configuration identical to the notches identified at 196, 196' in FIG. 14 (which are seen to be present, in FIG. 13 at the side of top sole 111). It may be noted that additional slots 197, 197' are provided forwardly of the respective notches 196, 196' for the passing under the top sole 111 of further straps which may be utilized with other rear or front quarters.

Notches corresponding to those designated 196, 196' in FIG. 13 at the sides of top sole 111 are also provided at the sides of layer 173, as designated at 198, 198' in FIG. 14. A similar notch is provided at the opposite sides of 173, as illustrated in FIG. 11 in dashed line and designated 199.

As in the previous embodiments, cooperative fabric is applied to the sides of such heel layers as layers such as those indicated at 200, 200' in FIG. 14 in the bottom faces of notches 198, 198'. Carried upon the faces of quarter straps 195, 195' are layers of the opposite type of cooperative fabric, in the manner of embodiment A, which layers are engageable with the layers presented at the notches, such as those layers 201, 201' illustrated in FIG. 14 and for the same purposes as in the previous embodiment. Alternatively, the rear quarter straps may be folded under top sole 111 and passing into space 184 (see FIG. 18) for interengagement with cooperative fabric layer 164 carried on the lower surface of the top sole, being then secured in the same manner as front quarter straps 120, 120'.

Embodiment C is provided with a heel cover 201 of a reversible nature, i.e., which has opposite surfaces of different colors or textures, as in previous embodiments. Cover 201 includes cooperative fabric tabs 203, 203' which are provided by lengths of such fabric folded around and secured to forward portions of heel cover 201, facilitating its removal for reversing it, etc.

Referring now to FIGS. 19–21, there is illustrated a shoe embodiment D having a lace-type vamp constituted by flexible laces of cord or tubing, as designated at 204, 204' and 205, 205' having respective portions 206, 207 which extend under the front half 210 of a top sole 211 of the shoe, as seen in FIG. 21 and secured by means of a key 208 within a slot 209 in front top sole half 210, all being described more fully hereinbelow. Laces 204, 204' and 205, 205' are intended to cross above the wearer's foot and extend rearwardly whereupon they then again extend under top sole 211 as indicated at 212 in FIG. 19, then re-emerging as sets of laces 213, 213' from rearward portions of top sole 211 to provide a rear quarter 215 of the shoe, again in the sling style previously noted.

Such portions 213, 213' are seen to extend through a heel piece 216 of bow-tie configuration, which for this purpose includes a pair of apertures **216*a*, 216*b* therein in the central portion. Heel piece 216 would preferably be constituted by a sheet of flexible synthetic resin material, such as double-faced vinyl or the like having contrasting colors on opposite faces, whereby the same is of a reversible nature. For tying the shoe upon the foot of the wearer, heel piece 216 includes a further pair of apertures as indicated at 216*a*, 216*b* through which a lace 217 having portions 217*a*, 217*b* extend to the opposite sides and then surround the ankle of the wearer to provide means for tying the sling about the ankle as indicated at 218. Manifestly, heel piece 216 is free to slide along the laces by virtue of the apertures 216*a*, 216*b*** therein, whereby the heel piece may be centered precisely at the rear of the ankle and above the heel of the wearer to achieve maximum comfort and proper alignment.

The shoe of embodiment D has a bottom sole or outsole 220 to which an upper outsole 221 is attached, the latter lying above outsole 220 along its rearward half and being preferably adhesively secured thereto. Above the front half of outsole 220 is insole 222 which may be regarded as a top sole which overlies the front portion of outsole 220 and then rises at the midpoint of the shoe above a wedge-shaped heel 223, whereby the topsole has a front portion **222*a* and rear portion 222*b*. Heel 223 is covered by a heel cover 225 which may be reversible. Extending peripherally around the upper surface of top sole 222 but not around the back of the top sole above heel 225 is a continuous welt 226, the latter being adhesively secured to top sole 222**. However, the welt optionally may be present only around the forward part of the shoe.

Preferably, outsole 220, upper outsole 221, as well as top sole 222 and welt 226 are each formed of a layer of molded elastomeric material such as rubber or rubber composition material as preferred for use in previous embodiments. While such molded materials of a resilient synthetic nature are preferred, leather or other flexible materials could be employed.

Of special significance is the fact that top sole 222 is of a configuration extending from one end of the shoe to the other, in contrast with the previous embodiments. Referring to FIG. 21, it will be seen that the front portion **222*a* of the top sole is formed, as by being stamped or cut with a die, to extend outwardly to the edges of the shoe on opposite sides of a hinge-like forward extension or portion 230 of the top sole at the instep region of the shoe just rearwardly of the ball of the wearer's foot. Said hinge-like portion 230 connects to topsole 222 a front half-sole 229 which may be deemed a half-insole or forward extension of the top sole. Half-sole 229 has dimensions such that a space 233 is provided peripherally between the half-sole and welt 226 except at hinge portion 230. Half-sole 229 is secured to the upper surface of outsole 220 by interengaged layers 231*a*, 231*b* of cooperative fabric whereby the half-sole can be readily detached and pulled back upon hinge portion 230** for replacement or adjustment of the front quarter.

Hinge portion 230 is bounded on opposite sides by a pair of tab-like forward extensions 235, 235', each defined by a pair of relatively closely spaced parallel slits 236, 236' at the opposite sides of the shoe which extend longitudinally of the shoe, whereby hinge portion 230 is approximately centered with respect to the shoe and extends longitudinally with respect thereto.

Extensions 235, 235' provide tabs for securement of the top sole to outsole 220 by securement within apertures of the outsole. To illustrate, referring to FIG. 22, extension 235 turns downwardly providing a tab 238 of rectangular cross-section fitting into a corresponding aperture 239 in outsole 220. Similarly, an aperture 239' receives a corresponding tab of extension 235'. Such tabs are preferably cemented or pinned or otherwise secured within apertures 239, 239' whereby the top sole is positionally fixed relative to outsole 220 but is resiliently secured thereto in a hinging relationship, as suggested by FIG. 22.

It is to be observed that slot 209 is a rectangular configuration and extends centrally of the flap-like top sole portion **222*a*. Key 208 is of a material preferably like that utilized for construction of top sole 222 and outsole 220 but of somewhat less length than slot 209, as seen in FIG. 21, in order to permit the key to be adjusted longitudinally within the slot for purposes of tightening of the laces. Lace portions 206, 207 extend through key 208 and are secured thereto as by being adhesively secured or pinned, etc. witin slots of the key. Top sole portion 222***a* is also provided with a plurality of vamp lace entry slots 240, 240' corresponding to slots 160, 160' of embodiment C and for similar purposes; i.e., to maintain the longitudinal positioning of the laces in a desired configuration such as that depicted.

A circular aperture 241 is also seen to be present in the forepart of portion 222*a* for receiving a thong, as in previous embodiments. The tip 242 of half-sole should be noted as being cut slightly square to provide additional space accommodating shifting of the half-sole during normal bending movement and also to permit the wearer to grasp the tip easily for pulling the half-sole back for reconfiguring or adjusting the shoe elements.

The mid-portion of top sole 222 is provided with a feature shown in FIG. 21 to comprise a plurality of apertures 243, 243' at opposite sides thereof whereby the middle portion of top sole 222 is provided with great flexibility for enhancing bending in response to normal action of the foot when wearing of the shoe but, at the same time, for providing a strong, dimensionally secure top sole. While apertures 243, 243' are shown of circular configuration, they may well be rectangular, slit-form or of other shapes. But it is preferred, in any event, that there be several such apertures in the middle portion of the top sole.

Of course, top sole 222 and half-sole 229 are suitably covered by a sock liner (not shown) of the same configuration previously described and preferably detachably secured by areas of interengaged cooperative fabric layers carried by the top sole and half-sole, but such areas are not shown in order to simplify the drawings.

Although embodiments C and D are both illustrated as having a single front quarter secured by a key-and-slot arrangement, it is to be understood that a convertible shoe constructed in accordance with the invention may utilize a similar key-and-slot arrangement for securement of not only the front quarter (or vamp) but also the rear quarter, such as the sling illustrated in embodiment C and previous embodiments. Therefore, it is manifest that such embodiment may utilize a similar arrangement wherein a slot of the same rectangular configuration as that depicted in midsole 222 in the forepart of the shoe may similarly be provided in the rear part of the shoe, as suggested by the outline of such slot-like aperture 245 in FIG. 21. However, with the use of a sling constituted by use of a lace-type rear quarter, as that shown in embodiment D, there exists no reason for securement of a rear quarter in the shoe as configured in the drawings, inasmuch as the sling constituted by lace portions 213, 213' is merely an extension of the lace which constitutes the front quarter of the shoe. However, in any event, a sling like that designated at 123 in embodiment C (FIG. 11) is utilized, the same may be secured by simply securing the strap extensions, e.g., 195, 195' to a key of the same type as depicted. Therefore, a convertible shoe of the present invention may well employ front and rear longitudinal slots, each having a key therein for securement of the respective front and rear quarters.

Referring now to FIGS. 23–25, there is depicted an embodiment E illustrating the use of various quarter features wherein the same may be fastened by the securement of extensions thereof by cooperative fabric interengagement with layers of a top sole or to layers of such cooperative fabric applied to upper surfaces of the front portion of the outsole. Or the same alternatively may be secured by use of a key-in-slot arrangement as disclosed for embodiments C and D. However, for present purposes, it is assumed that such shoe employs a body which is identical with that utilized with embodiment D, and, accordingly, the same includes an outsole 222 having at the rear portion thereof an upper outsole 221 applied thereto, upon which is applied a heel 223 having a heel cover 225 of the previously described reversible nature. Lying along the entire top of the shoe is a top sole 222 including a front portion 222*a* surrounded by a welt 226 and a heel portion or rear portion 222*b*.

Attached to the shoe is a front quarter or vamp 246 of open-toe type constituted by two portions 247, 247' which are interconnected centrally of the shoe by lacing 249 through eyelets or apertures 250, 250' of the respective portions, and tied as indicated at 251. Such portions 247, 247' have extensions which, like quarter extensions 139 and 140*a*, 140*b* of embodiment C are interconnected with a key 253 fitting within a longitudinally extending rectangular slot 254 within front top sole portion 222*a*. The assembly is covered by a sock liner 255, all as substantially shown and previously described in connection with embodiment C (FIG. 14).

At the rear of the shoe is a sling-type rear quarter 257 which similarly may be secured by key-and-slot arrangement as that just described or may be instead secured in the same manner as that shown in connection with embodiment C, wherein portions of the quarter extend downwardly along sides of the heel 223 beneath heel cover 225 and are secured by cooperative fabric interengagement with side surfaces of the heel. Regardless of the manner secured, sling-type quarter 257 has portions 258, 258' which are joined at the back of the shoe. For this purpose, it is employed to utilize a band or strap 259 of elastic material which is secured to marginal portions 260, 260' of the respective quarter halves or portions 258, 258'. These marginal portions 260, 260' are split as seen in FIG. 25 with portions 261, 261' of the elastic band being fitted within the split marginal portions and there stitched in place or otherwise secured, as by adhesive. Accordingly, the rear quarter is provided with an elastic stretch feature for accommodating the wearer's heel with a resilient and comfortable grip regardless of size. Alternatively, a lace and tie configuration as utilized for the front quarter may be provided for interengagement of the portions of the rear quarter. Conversely, an elastic band arrangement as shown in connection with the rear quarter may be utilized for securement of the portions 247, 247' of the front quarter, again for the same purpose of providing elastic securement about the foot to achieve comfort and proper fit regardless of size.

Rear quarter 257 is also provided with a string or lace-type tie 263 threaded through eyelets 264 in opposite side portions 258,258' of the vamp for tying the rear quarter about the wearer's ankle.

Referring to FIGS. 26–31, a further shoe embodiment F is illustrated, demonstrating further possibilities comprehended by the invention.

Figure 31:
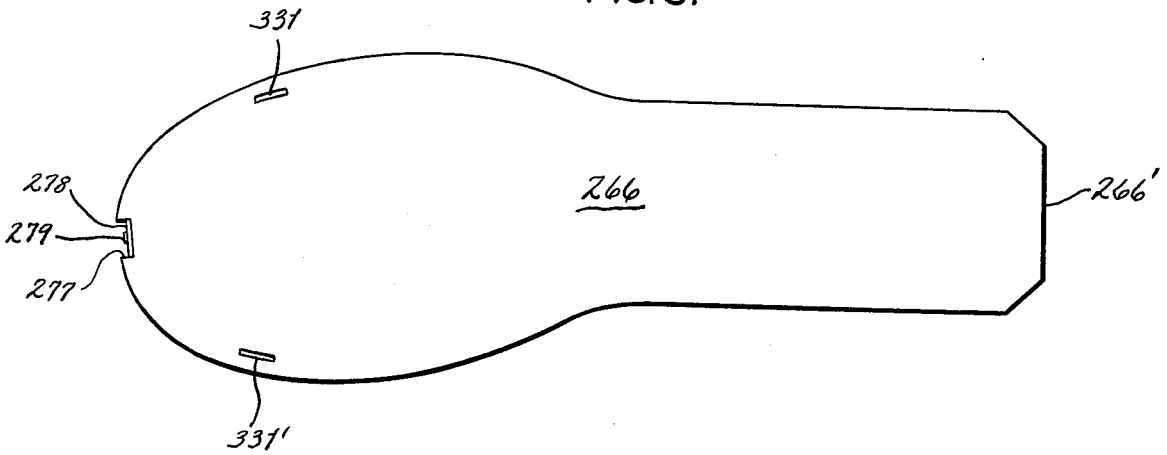
FIG. 31 is a bottom plan view of the shoe of FIG. 26.

Embodiment F is a shoe of "wedgie" type having a bottom sole or outsole 266 to the top of which a topsole 267 is attached, said topsole having a toe portion 268*a*, and a central portion 268*b* secured to a corresponding central portion of outsole 266, and a heel portion 268*c* which is carried upon a heel 270 of wedge-defining character. Accordingly, topsole 267 extends the full length of the shoe. Topsole toe portion 268*a* is, in effect, an insole of the shoe. Outsole 266 and topsole 267 preferably are formed, as by die stamping of elastomeric materials of the same type as preferred for previous embodiments. Outsole 266 has a squared-off rear margin 266' (FIG. 31).

Lying atop the forward and central portions 268*a*,268*b* of the topsole is a sock liner 275 which is seen to terminate at its rearward extremity at a point approximately aligned with the forward portion of heel 270, the latter being seated upon an upper half-outsole 272 which overlies the rear or heel portion of outsole 266 and is of identical plan shape throughout the extent of its overlying relationship with outsole 266.

Topsole 267 is preferably secured to the forward portion of upper half-outsole 272, as well as central portions of outsole 266 as by cementing, stapling or other fastening means only throughout a central region 273, whereby the topsole toe portion 268*a* and heel portion 268*c* are left unsecured to the underlying structure of the shoe, being held thereto only by auxiliary structure elements of the shoe which will shortly be apparent.

Sock liner 275 is hingedly secured to a notch 277 in a front peripheral surface of outsole 266 by a short strap 278 of flexible material. One end of strap 278 is fitted within notch 277 as by a pin 279 extending horizontally into the outsole. The other end is affixed as by a staple 281 or by stitching, etc. to the toe of sock liner 275. Said sock liner covers securement structure of the shoe and provides a comfortable surface for the wearer.

Extending upwardly from outsole 266 through notches or recesses 283,283' of the topsole toe portion 268*a* are opposite sides 274,274' of a strap-like vamp or front quarter 286. Such may be but one of a plurality of vamp or front quarter portions which may be either separate or integrally formed, one such further vamp portion being representatively indicated in phantom at 287 and securable to the shoe in a manner to be explained.

Preferably, although not necessarily, the new embodiment may be provided, as illustrated, with a rear quarter 289 of the general character shown in previous embodiments and having a string tie 288 or other means for securing the rear quarter about the ankle of the wearer. Various types of rear quarters are possible, such as one of the various configurations previously illustrated, wherein the quarter is defined by opposite strap-like portions 291,291' which extend under the heel portion 268*c* of the topsole and are secured in a manner more fully manifested below.

Figure 30:
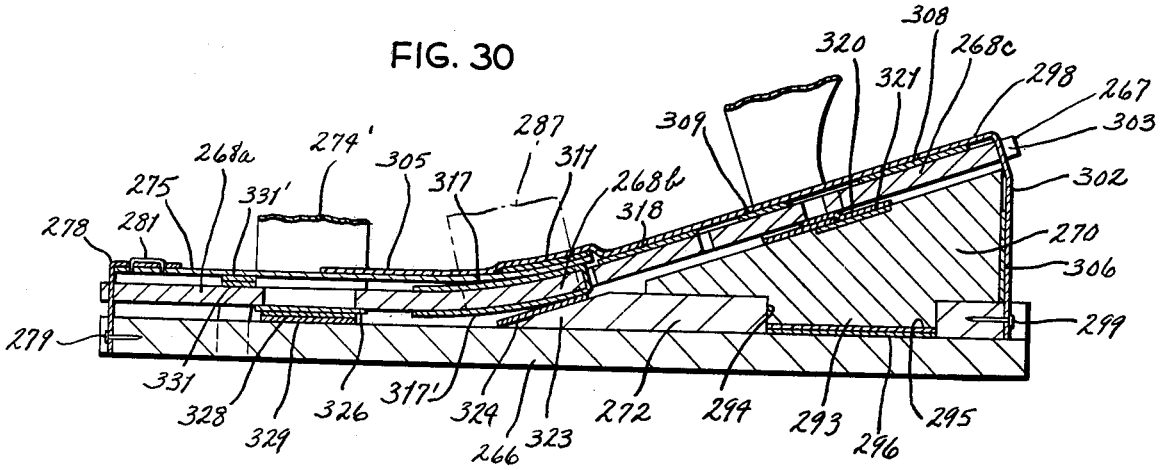
FIG. 30 is a vertical transverse cross-sectional view taken along line 30—30 of FIG. 27.

Referring to FIG. 30, heel 270 is provided with a downwardly extending key 293 of rectangular character and preferably of width which is substantially less than that of the main body of heel 270, said key fitting within a corresponding rectangular-shaped recess 294 in upper half-outsole 272. The key has a layer 295 of a first type of cooperative fabric secured, as by adhesive, to its lower face. Layer 295 is adapted for engagement with a further layer 296 of opposite type cooperative fabric which is secured to the upper surface of outsole 266 within the area of recess 294, the latter layer being also adhesively affixed. Accordingly, key 293 is retained within recess 294.

In a configuration similar to previous embodiments, a heel securement strap 298 further retains heel 270, which may be of various desired heights, in place. Said strap has one end secured, as by a pin 299, within a notch 301 within the peripheral rear surface of half-outsole 272 and thence extending upwardly as a vertical reach 302 and through a corresponding notch 303 at the rear of topsole 267. The strap then extends forwardly along the upper surface of topsole 267, having a forward end 305 overlying the rear portion of sock liner 275. Preferably, the entire inner surface of strap 298 carries cooperative fabric, e.g., of the pile or female type. Alternatively, the entire strap may be of such cooperative fabric. In either event, such fabric provides selectively detachable interengagement with cooperative fabric areas of opposite type as illustrated at 306 at the rear of heel 270. Further such areas 308,309 are carried upon the upper surface of topsole heel portion 268*c*. Thus, strap 298 is detechably secured by such areas 308,309 for retaining topsole portion 268*c* and heel 270 in secure relationship upon the shoe.

A further layer 311 of the cooperative fabric of type type opposite to that carried by strap 298 is adhesively secured or stapled to the rear of sock liner 275 whereby heel strap portion 305 is detachably secured to sock liner 275 in tension and with the sock liner flat against the toe and central portions 268*a*,268*b* of the topsole.

Figure 28:
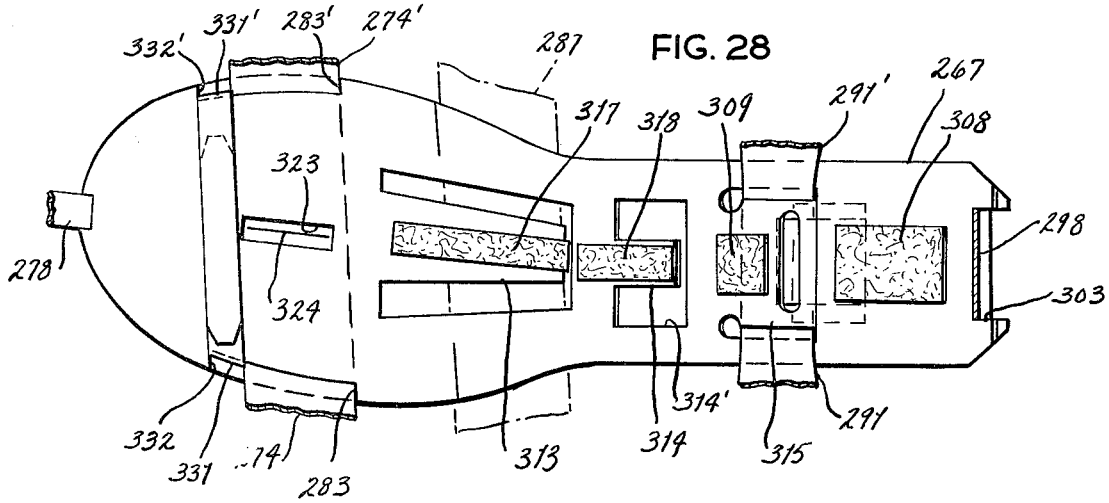
FIG. 28 is a top plan view of the shoe of FIG. 26 with a top sole thereof having been removed.

Referring to FIG. 28, topsole 267 is seen to be provided with a plurality of tabs 313,314 and 315, each defined by stamping out U-shaped areas of the topsole to leave the respective tab surrounded by a voided area and with each such tab extending rearwardly. Because of the elastomeric nature of the topsole, each such tab is effectively hinged at its base and may be pulled upwardly by the user against the resilient tendency of the material to lie flat. The user would do so for the purpose of fitting beneath the tab a front or rear quarter of the desired configuration.

One such tab 315 is seen to secure the strap-like sides 291,291' of rear quarter 289, it being understood that such sides are joined beneath tab 315. Each such tab preferably also is provided with respective adhesively secured or stapled areas of cooperative fabric 317,318, as well as the previously identified cooperative fabric area 309 for permitting heel securement strap 298 to be detachably secured thereto. These various areas permit detachable securement of corresponding areas of opposite type cooperative fabric carried by various possible quarters to be detachably secured to the shoe in the area of the respective tab. It is noted that tab 313 is of substantially greater length than the two more rearwardly located tabs whereupon a relatively wide front quarter may be secured thereunder. It will be apparent from FIG. 28 that one such additional quarter 287, as previously described, is received under tab 313. For the purpose of receiving the various quarters, it is noted that the voided area around each such tab, e.g., that designated 314' which surrounds tab 314, is of width slightly greater than that of the heel securement strap 298.

Immediately below tab 315 is a layer 320 of cooperative fabric which is secured at least through a small extent of its area to provide a hinged configuration, such layer being detachably interengaged with a further layer 321 of opposite type cooperative fabric. It is further to be observed that tab 313 may have said area of cooperative fabric 317 wrapped around the distal end of the tab and extending thereunder toward the front of the shoe whereupon an area 317' of the cooperative fabric is provided beneath the tab for detachable securement of a front quarter which has been provided with a corresponding area of opposite type cooperative fabric.

In a manner similar to rear quarter 287, front quarter 286 has its opposite sides 274,274' integrally joined beneath topsole toe portion 268*c*. Located centrally of said toe portion is a longitudinally extending narrow slot 323 providing in effect a window through which the joined straps are apparent but more specifically permitting a longitudinal index marking 324 to be aligned within the slot for proper side-by-side adjustment of the front quarter straps 284,284' to be made. Such is especially desirable where the front quarter is not of the continuous loop form which is shown at 286 but is instead of the type which, as in FIG. 19, is of the form which extends from the toe portion of the shoe rearwardly in overlapping relationship and which has portions which are interengaged with the topsole at a more rearward location wherein misalignment at the toe of the shoe would result in increased or further misalignment at the points of more rearward securement. Accordingly, this index alignment feature is particularly useful with what may be indicated as an elongated quarter or vamp.

Figure 29:
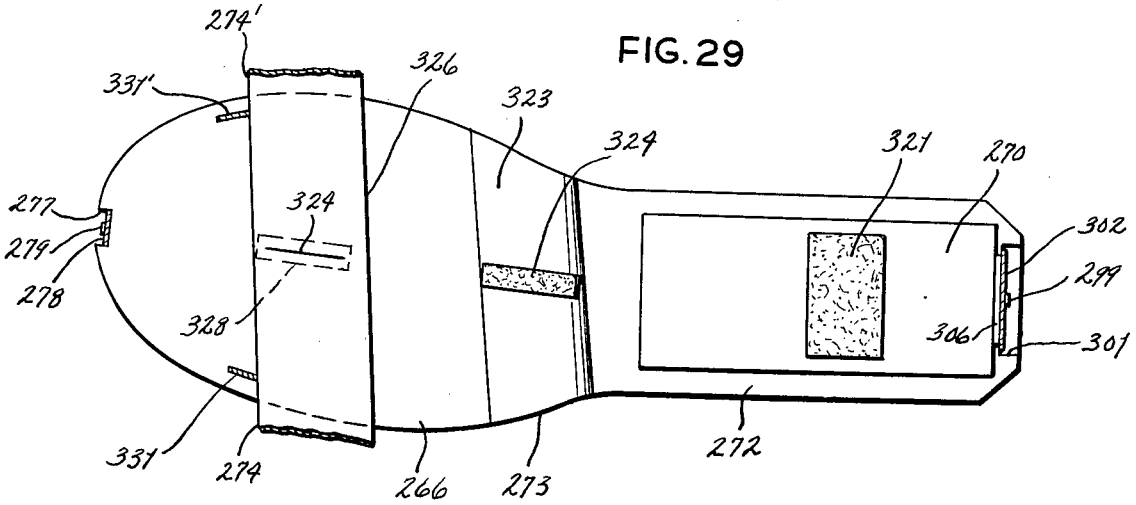
FIG. 29 is a top plan view of certain further portions of the shoe having been removed.

Referring to FIG. 29, the structure of the shoe with the topsole 267 having been removed is apparent. There, it will be seen that just rearwardly of region 273 in which upper half-outsole 272 is secured to the upper surface of outsole 266, there is a thin transition region 323 of tapering thickness of the material constituting a half-outsole 272. Carried centrally within such region is an area 324 of cooperative fabric for engaging the cooperative fabric 317' which is carried upon the undersurface of tab 313, whereby the latter will be more securely held down.

Also in FIG. 29, it is apparent that strap portions 274,274' of the representative front quarter or vamp 286 are but extensions of continuous strap 326 which overlies the toe portion of the outsole 266. Preferably the latter has affixed to it an area 328 of cooperative fabric for detachable engagement of a similar area 329 of opposite type cooperative fabric carried by the strap portion 326 of the desired vamp or front quarter, as by being stapled or adhesively secured to such strap portion.

For purposes of assembling the new shoe in a desired configuration, the toe portion 268*c* of the topsole is raised, being hingedly affixed to the outsole region 273, and flexibly interengaging the top surface of outsole 266. Strap portion 326 of the front quarter fits under toe portion 268*c* with areas 328,329 of cooperative fabric being pressed together to temporarily affix the front quarter to the shoe. Thereafter, the toe portion 268*c* of the upper is pressed downwardly. Retention of the same in such position by an arrangement of overlapping straps which are secured to the outsole in the toe portion thereof. More specifically, straps 331,331' are each pinned or affixed to outsole 266 on opposite sides thereof and extend upwardly and around the side edges of topsole portion 268*a* which has recesses 332,332' at opposite sides thereof, which may be forward extensions of recesses for accommodating such straps. The straps themselves preferably are of opposite type of cooperative fabric and such are adapted to be overlapped as depicted in FIG. 28 in transverse relationship across the toe of the shoe. Straps 331,331' are then pressed down in tight fitting relationship for tightly maintaining topsole toe portion 268*a* against the overlying upper surface of outsole 266. Thereafter, sock liner 275 is folded back across the upper surface of the top sole, covering straps 331,331'. Heel strap portion 305 is then laid atop the sock liner and secured thereto by interengagement of area 311 of cooperative fabric with the corresponding area 317 of opposite type fabric carried by tab 313.

Accordingly, changing of quarters or adjustment thereof are readily facilitated but, because of the centrally secured region 273, the topsole elements are maintained affixed to the outsole in requisite aligned relationship and without their possibly becoming detached or lost.

Various elongated vamps are similarly affixed to the shoe with each in any event having a portion corresponding to strap segment 326 for fitting under the topsole toe portion 268a, but also having other strap-like portions which may be fitted under one of tabs 313 or 314 or, for that matter, extending rearwardly toward the heel of the shoe and providing an integral structure including a rear quarter similar to or different from quarter 287.

Although the foregoing includes description and illustration of the best modes contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

Having described my invention, what I claim and desire to obtain by Letters Patent is:

1. An article of footwear of selectively reconfigurable wedgie character, said article of footwear comprising an outsole of unitary construction having a toe portion, a central portion, and a heel portion, an upper half-outsole overlying said heel portion and having a forward wedge-defining portion terminating at the central portion of said outsole, said upper half-outsole being secured to said outsole, a heel also of wedge-defining character seated upon said upper half-outsole in removable relationship, a topsole overlying said heel, the forward wedge-defining portion of said upper half-outsole, and the toe portion of said outsole, first hinge-defining means flexibly interengaging said topsole and the forward portion of said upper half-outsole above the central portion of said outsole, a sock liner overlying said topsole, second hinge-defining means flexibly interengaging a toe portion of said sock liner and the toe portion of said outsole, said sock liner extending rearwardly from said second hinge-defining means toward said heel, a securement strap extending upwardly from the heel portion of said outsole at the rear of said heel and forwardly above a heel portion of said topsole, and means for detachably securing said securement strap to said sock liner with said strap and sock liner in tension thereby to maintain said sock liner and said heel portion of said top sole in relative position, and upper defining means detachably secured to said article of footwear at toe and heel portions thereof.

2. An article of footwear as defined in claim 1, said outsole being of substantially constant thickness, said upper half-outsole having throughout its major extent a substantially constant thickness but tapering to a reduced thickness portion to provide said wedge-defining portion.

3. An article of footwear as defined in claim 1, said topsole being provided with a plurality of rearwardly extending tabs each surrounded by a voided area, said topsole being of an elastomeric nature having a resilient tendency to lie flat, each such tab being thus effectively hinged at its base for permitting the respective tab to be pulled upwardly against said resilient tendency for permitting said upper defining means to be secured by fitting portions thereof beneath the respective tab.

4. An article of footwear as defined in claim 1, the toe portion of said topsole being liftably detachable from said toe portion of said outsole by movement upward relative to said outsole about said first hinge-defining means.

5. An article of footwear as defined in claim 4, and further comprising a front upper, means for providing detachable interengagement of said fron upper with the toe portion of said topsole, said topsole and upper providing selective removal and replacement as a single unit upon said outsole, said front upper comprising at least one securement portion of strap-like character oriented for extending transversely of said article of footwear interposed between the toe portion of said outsole and the toe portion of said topsole, said unit being capable of extrinsic separation of said insole and upper, whereby replacement or reconfiguring of said front upper is made convenient and easy for the user.

6. An article of footwear as defined in claim 5, said upper being defined by at least one layer of material adapted to extend across the forepart of the foot of the user, said layer having opposite faces each suited for constituting the outer surface of said upper, said upper being adapted for being turned inside out whereby it is of a reversible nature.

7. An article of footwear as defined in claim 5, said means detachably securing said insole to the toe portion of said outsole comprising an interengageable plurality of layers of cooperative fabric carried by the respective toe portions of said outsole and topsole.

8. An article of footwear as defined in claim 7, said upper being constituted by material adapted to extend across the forepart of the foot of the user, said material having marginal portions passing under said insole at the sides thereof.

9. An article of footwear as defined in claim 8, said marginal portions os said upper material being joined together beneath the toe portion of said topsole and constituting said securement portion of strap-like character, said upper carrying layers of cooperative fabric for interengagement with said layers of cooperative fabric carried by said outsole and insole, respectively.

10. An article of footwear as defined in claim 1, said sock liner being constituted by a single sheet of integral construction for extending rearwardly over at least a portion of said topsole for covering the same to provide a single continuous surface upon which to place the foot of the wearer, the undersurface of said sock liner and the upper surface of said topsole each carrying layers of cooperative fabric constituting said means detachably securing said sock liner to said topsole.

11. An article of footwear as defined in claim 1, said heel being detachably secured to said outsole, said heel including a key, said outsole being provided with at least one aperture of shape corresponding to said key for receiving said key in close-fitting relationship for precise securement of said heel relative to said outsole and topsole.

12. An article of footwear as defined in claim 1, the rear surface of said heel being provided with a vertically extending recess for receiving said first portion of said strap.

13. An article of footwear as defined in claim 1, said topsole being provided with an aperture proximate its rearward end, said securement strap passing through said aperture, said means detachably securing said strap second portion comprising a plurality of interengageable layers of cooperative fabric carried by said second portion and topsole, respectively.

14. An article of footwear as defined in claim 1, said upper defining means comprising a rear quarter, said rear quarter having strap portions extending downwardly therefrom and thence under the heel portion of said topsole, and means for detachably securing said strap portions.

* * * * *